United States Patent [19]

Simpson

[11] Patent Number: 4,700,522

[45] Date of Patent: Oct. 20, 1987

[54] STANDING SEAM SIDELAP SYSTEM AND METHOD FOR ASSEMBLING SAME

[75] Inventor: Harold S. Simpson, Oklahoma City, Okla.

[73] Assignee: Harold Simpson, Inc., Oklahoma City, Okla.

[21] Appl. No.: 481,844

[22] Filed: Apr. 4, 1983

Related U.S. Application Data

[63] Continuation-in-part of Ser. No. 425,477, Sep. 28, 1982, Pat. No. 4,497,151.

[51] Int. Cl.[4] ..... E04D 1/00

[52] U.S. Cl. ..... 52/528; 52/542; 52/478; 52/747; 52/545

[58] Field of Search ..... 52/542, 478, 747, 545, 52/534, 528, 518, 520

[56] References Cited

U.S. PATENT DOCUMENTS

| | | | |
|---|---|---|---|
| 2,565,610 | 8/1951 | Kinghorn . | |
| 3,394,515 | 7/1968 | Widdowson | 52/478 X |
| 3,481,094 | 12/1969 | Taylor | 52/534 X |
| 3,998,019 | 12/1976 | Reinwall, Jr. | 52/478 |
| 4,102,105 | 7/1978 | Taylor et al. | 52/528 X |
| 4,168,596 | 9/1979 | Yader, Jr. | 52/520 X |
| 4,213,282 | 7/1980 | Heckelsberg | 52/478 X |
| 4,361,998 | 12/1982 | Ellison et al. | 52/520 |
| 4,497,151 | 2/1985 | Simpson et al. | 52/543 X |

*Primary Examiner*—Carl D. Friedman

*Attorney, Agent, or Firm*—Bill D. McCarthy

[57] ABSTRACT

An improved standing seam floating roof and method for fabricating a standing seam floating roof with a plurality of panels is provided wherein the panels are interconnected via a female connecting assembly formed along at least a substantial portion of one side of each panel and a male connecting assembly formed along at least a substantial portion of the other side of each of the panels. The female connecting assembly, which defines a male assembly receiving cavity, is provided with a lip member extending across a portion of the male assembly receiving cavity to partially close off the opening to the male assembly receiving cavity. The male connecting assembly is provided with a lip engaging member such that upon positioning the male connecting assembly into the male assembly receiving cavity of the female connecting assembly, the lip engaging member of the male connecting assembly lockingly engages the lip member of the female connecting assembly to resist disengagement of the joint. A resilient sealant is disposed in an upper or apex portion of the male assembly receiving cavity of the female connecting assembly so that upon positioning and forcing the male connecting assembly upwardly into the male assembly receiving cavity, the male and female connecting assemblies cooperate to substantially uniformly compress the resilient sealant disposed in the upper portion of the male assembly receiving cavity of the female connecting assembly.

15 Claims, 19 Drawing Figures

STANDING SEAM SIDELAP SYSTEM AND METHOD FOR ASSEMBLING SAME

CROSS REFERENCE TO RELATED APPLICATIONS

The present application is a continuation-in-part to U.S. patent application Ser. No. 425,477 filed Sept. 28, 1982 by Harold G. Simpson and Bert D. Hollman, and now U.S. Pat. No. 4,497,151 issued Feb. 5, 1985, said application previously co-pending with the present application.

BACKGROUND

1. Field of the Invention

The present invention relates to building assemblies having standing seam sidelap systems, and more particularly but not by way of limitation, to an improved standing seam sidelap metal roof. In one aspect, the present invention relates to an improved panel and a method for assembling panels to form a standing seam sidelap metal roof.

2. Discussion of Prior Art

The pre-engineered building industry has developed into a very large segment of the building construction industry in the United States, and it has experienced an increasingly greater share of the construction industry budget throughout the world. The established method of erecting the roof or wall of a pre-engineered building is to erect the building frame which is comprised of primary and secondary structural members supported by a foundation. Once the foundation is constructed, the primary structural members are erected and attached to the foundation; next, the secondary structural members are connected across the primary structural members. Appropriate bracing members are interconnected, and roll blanket insulation is placed either across or parallel with the secondary structural members and temporarily secured in place by weights or some other securing means.

The panel members are then disposed over the blanket insulation, and the panel members and underlying secondary structural members are connected together by fasteners. Typically, the attachment of roof panel members is done by workmen who stand on top of the panel members and attach the panel members to the underlying secondary structural members (which will usually be purlins or bar joists). The panel rests substantially on the underlying secondary structural member.

The purpose of connecting the panel to the secondary structural member is to secure the panel members and to transfer externally imposed load from the panel members to the secondary structural members, which in turn transfers the stress to the primary structural members. These imposed loads create stress which may be tension, shear or compressive stress. As to the latter, compressive stress is created by inwardly directed live load which is transferred through the blanket insulation.

Numerous types of roof assemblies have heretofore been proposed for a pre-engineered building in an effort to provide a watertight roof assembly, while at the same time enabling the roof assembly to expand and contract as changes in temperature are encountered. Typical of such a prior art roof assembly which has met with considerable success in recent years is the standing seam roof assembly. The panel members of the standing seam roof assembly are joined to each other along adjacent sides such that the sides are lapped together to form the standing seams. The panel members of the standing seam roof are secured to the secondary structural members by means of clips. The interconnection of the panel members of the standing seam roof lend stiffness and strength to the roof structure, while allowing the roof structure to expand and contract as a function of the coefficient of expansion of the materials of which the roof panels are made and the temperature cycles to which the roof panels are exposed.

The repeated action of expansion and contraction on the panel members of the roof assembly tends to weaken the panel-to-panel-to-lap joint and often causes panels to separate or structural failure and leaks in the roof assembly. The leaks are generally caused by the weakening of the fastening members and working or kneading of the sealant used at the joints. In many of the prior art roof assemblies, the sealant employed required adhesion, flexibility and water repellency. Further, the design of the joint was in many instances such that the pressure on the sealant varied greatly throughout the length of the sidelap and endlap joints of the panels and resulted in uneven distribution and/or voids of the sealant in the joints which frequently led to leaks.

Many of the before-mentioned problems encountered in the prior art standing seam roof assemblies, such as structural failures and leaks, have been overcome by the improved standing seam metal floating roof assembly disclosed in copending U.S. patent application Ser. No. 425,477, filed Sept. 28, 1982 by Harold G. Simpson and Bert D. Hollman, and now U.S. Pat. No. 4,497,151 issued Feb. 5, 1985. standing seam floating roof assembly of the before-mentioned copending patent application is formed of elongated metal panels, each of which is provided with a female member formed along one side portion of the panel and a male member formed along the opposed side portion of the panel such that adjacent panels are interlocked with the female and male members thereof to form the standing seam. A clip having a slidable upper portion is secured between the standing seam of the roof assembly and the secondary structure such that the upper portion of the clip is disposed between the male and female members of the panels forming a standing seam. The clip is further constructed so that relative motion between the clip and the metal panels is substantially prevented. To assist in the watertightness of the standing seam a resilient material is disposed in the upper portion of the standing seam between the female member and the male member.

The structure and features of the improved standing seam floating roof assembly disclosed in the before-mentioned patent application achieves the objective of providing an improved watertight standing seam floating roof assembly wherein the resilient material is clamped between adjoining male and female members of the panels without the aid of a field-seaming machine or the necessity of assembling and rotating the panel being assembled into a pre-designated position. However, problems may nevertheless be encountered due to human involvement in the construction of the standing seam roof assembly, especially in the formation of a watertight, structurally sound, quality-consistent standing seam by the union of the male member of one panel with the adjacently disposed female member of a second panel. Further, separation of the standing seam (i.e. the union found between the male member of one panel and the female member of the adjacently disposed panel) may result when the panels are subjected to differential loads, such as may be encountered when one panel expands or contracts differently than an adjacent panel, or when an uplift load, such as may be created by wind, is encountered by the panels forming the standing seam roof assembly. Thus, a need remains for an improved panel and standing seam roof assembly wherein the watertightness and structural integrity of the standing seam is not adversely affected when diverse loads are applied to the panels forming the standing seam, as well as a method for assembling such an improved standing seam roof assembly which substantially eliminates human error encountered in the formation of the standing seam by union of adjacent panels via the male and female members of the standing seam, and enables one to more readily provide for proper alignment and improved structural engagement of the male and female members of the standing seam so as to improve the joint integrity of the standing seam.

SUMMARY OF THE INVENTION

The present invention relates to an improved panel for use in a standing seam floating roof. Broadly, the standing seam floating roof is fabricated of a plurality of panels interconnected via a female connecting assembly formed along at least a substantial portion of one side of each panel and a male connecting assembly formed along at least a substantial portion of the other side of each of the panels. The female connecting assembly, which defines a male receiving cavity, is provided with a lip member extending across a portion of the male assembly receiving cavity to partially close off the opening to the male assembly receiving cavity. The male connecting assembly is provided with a lip engaging member such that upon positioning the male connecting assembly into the male assembly receiving cavity of the female connecting assembly, the lip engaging member of the male connecting assembly engages the lip member of a female connecting assembly and is movable in a first direction to direct the male connecting assembly into a mating relationship with the female connecting assembly. The lip member and the lip engaging member of the male and female connecting assemblies are constructed such that after proper engagement of the male and female connecting assemblies, the lip engaging member of the male connecting assembly lockingly engages the lip member of the female connecting assembly to resist movement of the lip engaging member along the lip member of the female connecting assembly in a second direction substantially opposite the first direction. To insure the watertightness of the standing seam formed by the union of the male and female connecting assemblies of adjacently disposed panels, a resilient sealant is disposed in an upper or apex portion of the male assembly receiving cavity of the female connecting assembly so that upon positioning and forcing the male connecting assembly upwardly into the male assembly receiving cavity, the male and female connecting assemblies cooperate to substantially uniformly compress the resilient sealant disposed in the upper portion of the male assembly receiving cavity of the female connecting assembly.

In another aspect the present invention relates to a method for enhancing joint integrity of a seam formed by union of a male and female connecting assembly of adjacently disposed panels wherein the female connecting assembly is provided with a male assembly receiving cavity and a lip member extending across a portion of the male assembly receiving cavity to partially close off an opening to the male assembly receiving cavity, and the male connecting assembly is provided with a lip engaging member engagable with the lip member of the female connecting assembly when the male and female connecting assemblies are in a mating relationship. Broadly, the method of enhancing the joint integrity of a seam formed by union of the male and female connecting assemblies comprises inserting the male connecting assembly into the male assembly receiving cavity of the female connecting assembly such that the lip engaging member of the male connecting assembly engages and is supported by the lip member of the female connecting assembly, and applying a force to the male connecting assembly so that the lip engaging member of the male connecting assembly slidably moves along the lip member of the female connecting assembly and urges the male connecting assembly upwardly into the male assembly receiving cavity and into a proper union with the female connecting assembly.

An object of the present invention is to provide an improved panel having a male connecting assembly and a female connecting assembly such that upon assembling the panels to form a standing seam roof assembly the male and female connecting assemblies of adjacent panels cooperate to exert a substantially uniform pressure on resilient mastic contained within the female connecting assembly to form a watertight gasket.

Another object of the present invention is to provide a method for controlling the joint integrity of a standing seam roof formed by adjacent panels having a male connecting assembly and a female connecting assembly.

Still another object of the present invention is to provide an improved panel and method for assembling the panels to form a standing seam roof assembly which substantially eliminates human error encountered in the joining of adjacent panels via male and female connecting assemblies of the panels.

Other objects, features and advantages of the present invention will become clear from a reading of the following detailed description when read in conjunction with the drawings and the appended claims.

BRIEF DESCRIPTION OF THE DRAWINGS

FIG. 8 is a fragmentary sectional view of the standing seam taken at 8—8 of FIG. 7.

FIG. 16 is an isometric view of a second hand implement useful in combination with the first hand implement illustrated in FIG. 15 to insure proper union of the male and female connecting assemblies of adjacently disposed panels in the formation of the standing seam.

DESCRIPTION

Figure 1:
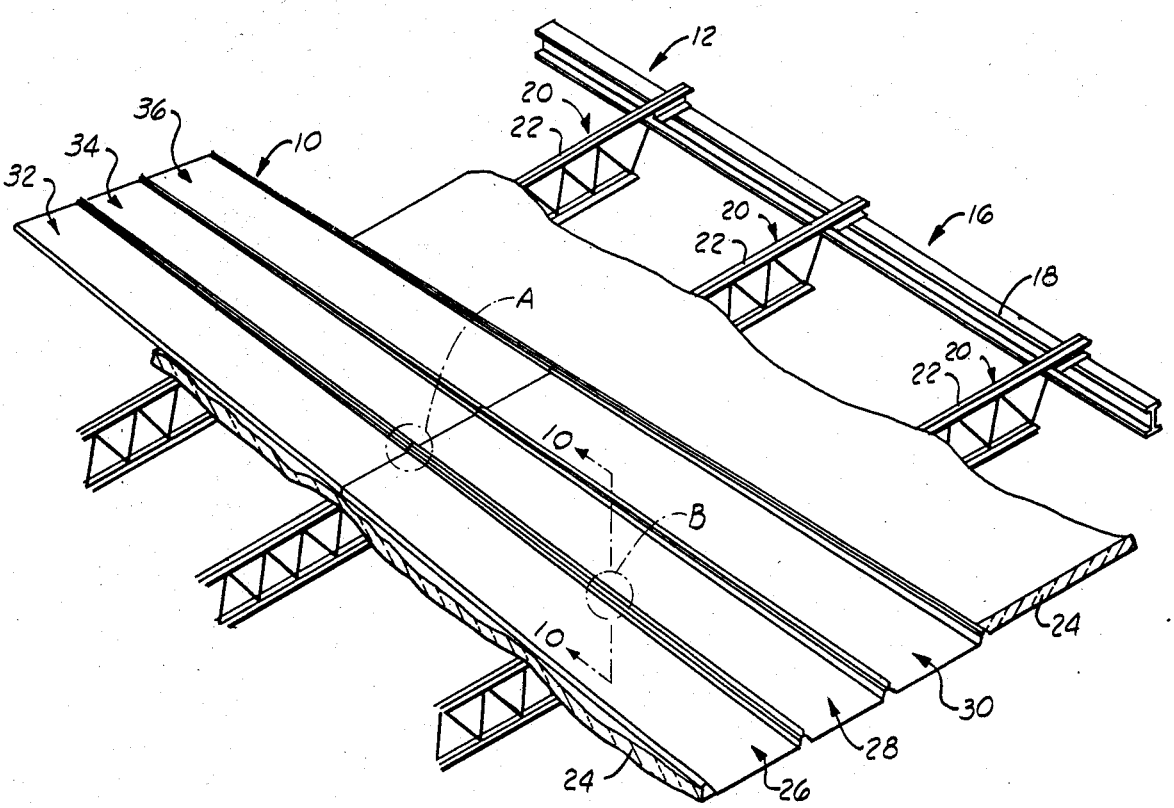
FIG. 1 is a partially broken perspective view of a portion of an improved standing seam roof assembly constructed in with the present invention.

Referring now to the drawings, and more particularly to FIG. 1, a portion of a building roof 10 is supported by a building structure 12. The building structure 12 comprises a primary structural system 16 which consists of a plurality of upwardly extending column members (not shown) that are rigidly connected to a foundation (also not shown). The primary structural system 12 has a plurality of primary beams 18 (only one beam shown) which are generally horizontally disposed and supported by the column members. A secondary structural system 20 comprising a plurality of open web beams or trusses 22, also referred to as bar joists, is supported by the primary beams 18 and is also generally horizontally disposed. While Z or C purlins or wood beams could as well be used as the secondary structural members in the practice of the present invention, the present invention will be described with reference to the bar joists 22 shown in FIG. 1.

The bar joists 22 of the secondary structural system 20 support insulation batts 24 and the building roof 10. The insulation batts 24 may be formed of any suitable insulating material, such as fiberglass, styrofoam, or the like. The building roof 10, a standing seam roof, is formed of a plurality of panels, such as panels 26, 28, 30, 32, 34 and 36. As illustrated, panels 26 and 28 are joined by a sidelap construction; whereas panels 26 and 32 are joined at their adjacent joint ends by an endlap construction. Panels 32 and 34 are joined along their sides by a sidelap similar to the junction of panels 26 and 28; and panels 28 and 34 are joined at their short ends in the same manner as panels 26 and 32. The four corners of the junction of panels 26, 28, 32 and 34 in the standing seam portion of the building roof 10 are associated and joined as will be more fully described hereinafter. It is to be understood that other panels of the building roof 10 are joined to adjacent panels in the same manner described above.

The panels, such as panels 26, 28, 30, 32, 34 and 36 forming the building roof 10, are substantially identical in construction. Thus, only panel 26, illustrated in FIG. 2, will be described in detail. The panel 26 comprises a body portion 40 having an elongated first side 42, a spatially disposed second side 44, a first end 46, and a opposed second end (not shown). The first side 42 and the second side 44 of the panel 26 comprise upstanding portions 43 and 45, respectively. A female connecting assembly 48 is formed along the upstanding portion 43 of the first side 42 of the panel 26 so as to extend a direction away from the body portion 40 substantially as shown. The female connecting assembly 48 terminates a selected distance 50 from the first end 46 of the panel 26 and a similar distance from the opposed second end (not shown) so that the upstanding portion 43 of the panel 26 and the female connecting assembly 48 cooperate to form a notched area 52 along each of the first end 46 and the opposed second end (not shown) of the panel 26. The female connecting assembly 48 defines a male assembly receiving cavity 54 such that a male connecting assembly of an adjacently disposed panel can be inserted therein and the two panels secured together for forming the standing seam.

A male connecting assembly 56 is disposed along at least a substantial portion of the second side 44 of the upstanding portion 45 of the panel 26 and terminates a selected distance 58 from the first end 46 of the panel 26 and a similar distance from the opposed second end (not shown) so that the upstanding portion 45 of the panel 26 and the male connecting assembly 56 cooperate to form notched area 60. For reasons which will become more apparent hereinafter, the male connecting assembly 56 extends longitudinally beyond the female connecting assembly 48 of each of the panels, such as panel 26, so that the distance 50 between the female connecting assembly 48 and the first end 46 (and the opposed second end, not shown) is greater than the distance 58 between the male connecting assembly 56 and the first end 46 and the opposed second end (not shown) of the panel 26. The male connecting assembly 56 is formed along the upstanding portion 45 of the panel 26 so as to extend in the direction toward the body portion 40 of the panel 26 substantially as shown.

As previously stated, the building roof 10 is fabricated of a plurality of panels, such as panels 26, 28, 30, 32, 34 and 36. In order to insure the water repellency of the building roof 10, a sealant, such as a mastic having desirable adhesion, resiliency, flexibility and water repellency properties, is disposed along portions of the panel which are joined to each other, such as at the endlaps or junctions.

Figure 3:
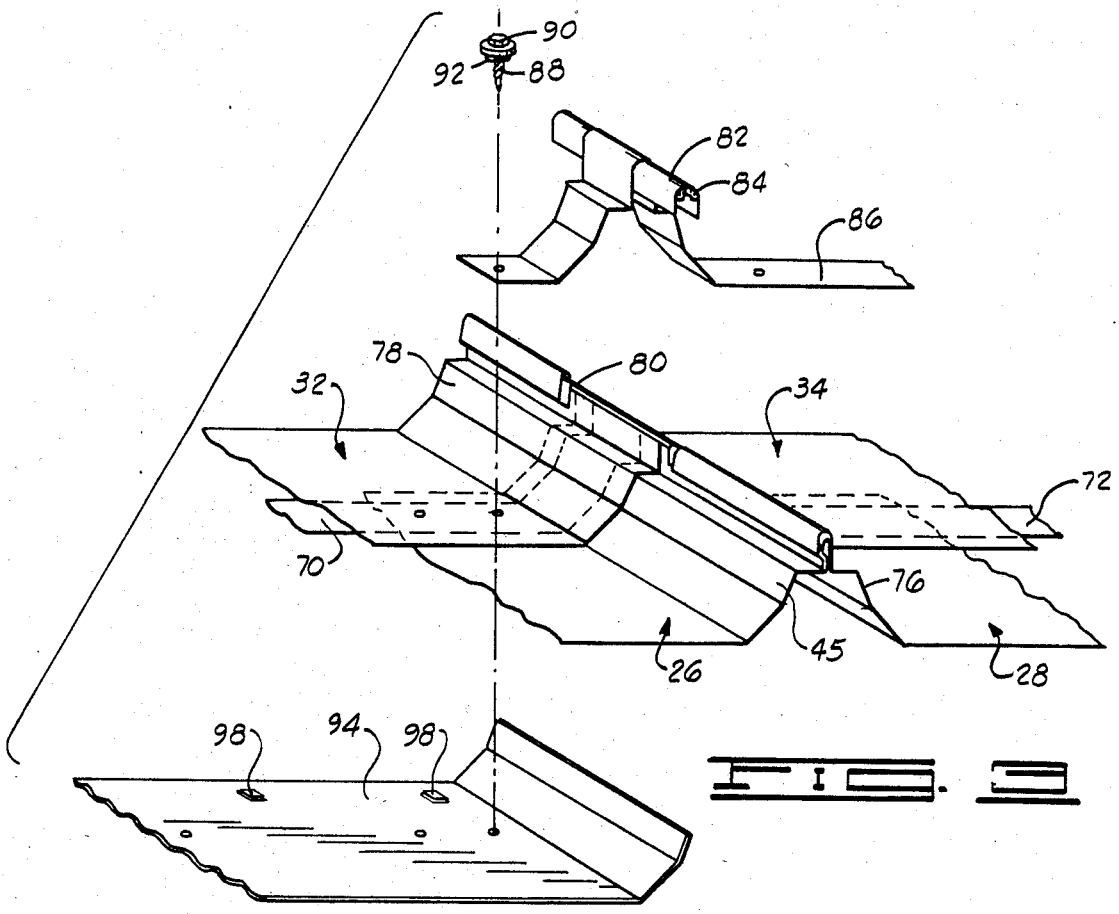
FIG. 3 is an exploded view showing an endlap and four-cornered junction of four adjacent panels, fragments of which are shown, of a standing seam roof assembly employing the improved panels of the present invention.

As shown in FIG. 3, the panel 26 is overlapped by the panel 32 and a sealant strip 70 is placed therebetween substantially as shown. Similarly, the panel 28 is overlapped by the panel 34 and a sealant strip 72 placed therebetween substantially as shown. Factory punched holes are formed in the endlap portions of each of the panels 26, 28, 30 and 34 to insure that the holes are coordinated and that the panels 26 and 28 are overlapped by the panels 32 and 34 by an amount sufficient to insure that the sealant strips 70 and 72 (see FIG. 4) are brought into proper relationship while at the same time upstanding portions 45 and 76 of the panels 26 and 28 are separated a pre-selected distance from upstanding portions 78, 80 of the panels 32 and 34. A mastic cup 82 containing a mastic 84 is positioned in the space formed between the upstanding portion 43 of the panel 26 (i.e. the female connecting assembly or member), and the upstanding portion 80 of the panel 34 (i.e. the female connecting assembly or member) so that the mastic cup 82 is supported by the upstanding portions 76, 78 of the panels 28, 32 (i.e. the male connecting assemblies or members) and the mastic 84 contained within the mastic cup 82 can be extruded into the before-mentioned panel separations to seal the joint. The mastic cup 82 is secured by a cinch strap 86 having factory punched holes therein which are alignable with the endlap factory punched holes of the panels 26, 28, 32 and 34 such that a self-tapping screw 88 having a head portion 90 can be disposed throught the aligned factory punched holes for securing the mastic cup 82 to the panel 26, 28, 32 and 34 via the cinch strap 86. A neoprene washer 92 (more clearly shown in FIG. 6) can be disposed between the head portion 90 of the self-tapping screw 88 and the panel 32 to further assure a watertight seal therebetween. While any suitable mastic can be employed as the mastic 84 in the mastic cup 82, the mastic will preferably be of a composition that will deform and extrude into the gaps between overlapped panel edges in the notched area of the endlap so as to insure a watertight seal.

The above description readily enables one to envision how the endlaps between the panels 26 and 32 and the endlaps between the panels 28 and 34 are accomplished. To further clarify the assembly of the building roof 10 a brief explanation of the order of assembly employing the panels 26, 28, 32 and 34 is set forth. In the assembly of the building roof 10 the panel 26 is positioned over the insulation batt 24, secured to the underlying secondary structural member, such as joist 22, and a backup plate 94 is placed under the end junction of the panel 26. Thereafter, the panel 32 is positioned over the insulation batt 24 so as to overlap the adjacent end portion of the panel 26 as heretofore described. The panel 28 is then positioned adjacently to panel 26 over the insulation batt 24, secured, and a similar backup plate (not shown) is placed under the end junction of the panel 28. Thereafter, panel 34 is adjacently disposed to panel 28 such that the end portion of the panel 34 adjacent to the end portion of the panel 28 overlaps such end portion in the manner heretofore described. The backup plates, such as the backup plate 94, and the cinch strap 86 are provided with factory punched holes which are alignable with the factory punched holes in the panels of the roof assembly 10, such as panels 26 and 32, so that upon alignment of the various components, the self-tapping screw 88 can be positioned therein to secure the components together.

Figure 6:
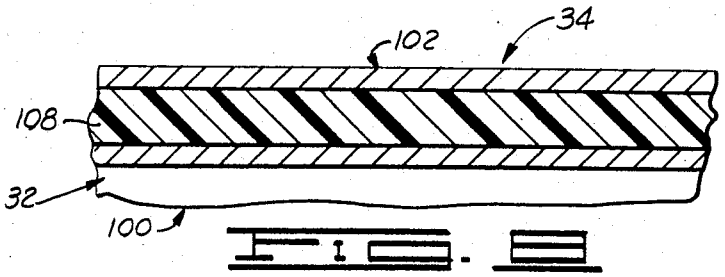
FIG. 6 an enlarged, exploded sectional view of an endlap of two panels of the standing seam roof assembly.

Referring now to FIG. 6, a backup fitting 96 is formed as an integrally raised member 98 having a recess into which the end of the panel 26 passes. The backup fitting 96 is constructed so that it is clipped onto the panel 26 and remains there without aid or support from the adjacent joist while the endlap assembly is completed. The self-tapping screw 88 is adapted to coact with the neoprene washer 92 to secure the assembly and to clamp the sealant strip 70 between the panels 26 and 32 of the roof assembly 10. The panels 28 and 34, which are identical in construction to the panels 26 and 32, are likewise interconnected with a backup fitting (not shown) and a self-tapping screw is adapted to coact with a neoprene washer to secure the assembly and clamp the sealant strip 72 between the panels 28 and 34 in a similar manner.

Figure 2:
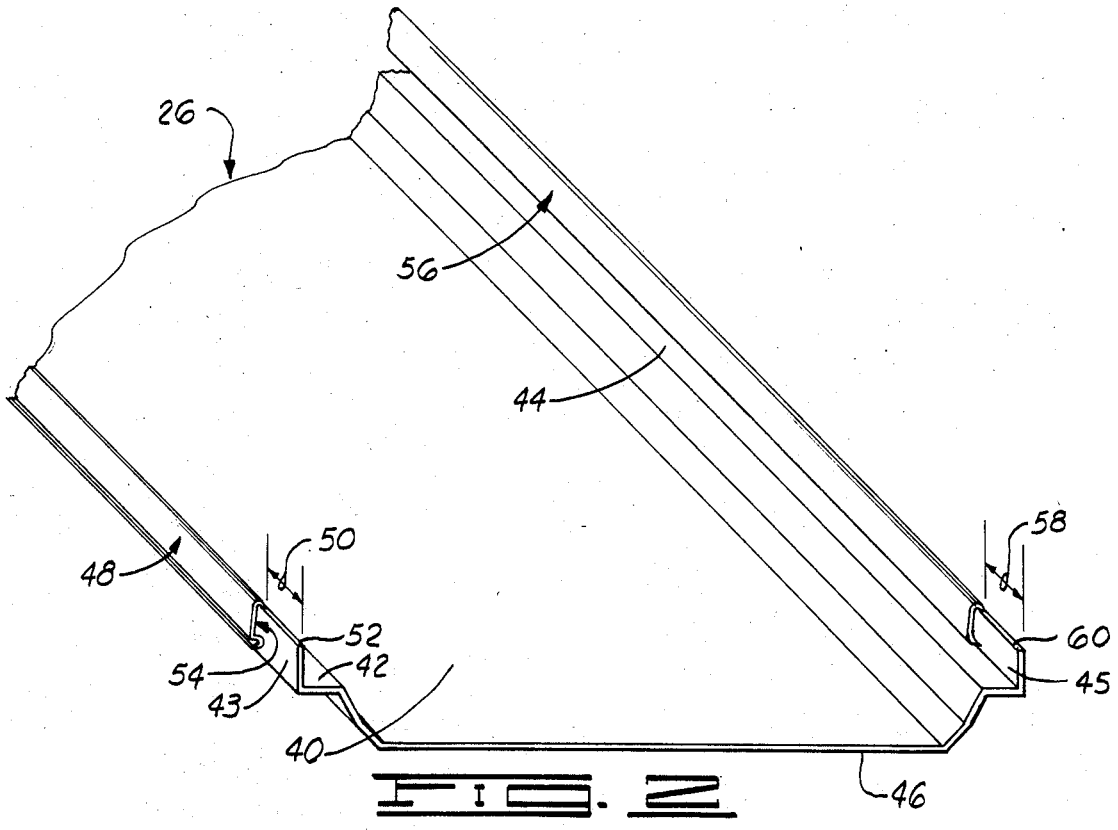
FIG. 2 is a partially broken isometric view of an improved panel constructed in accordance with the present invention.
Figure 4:
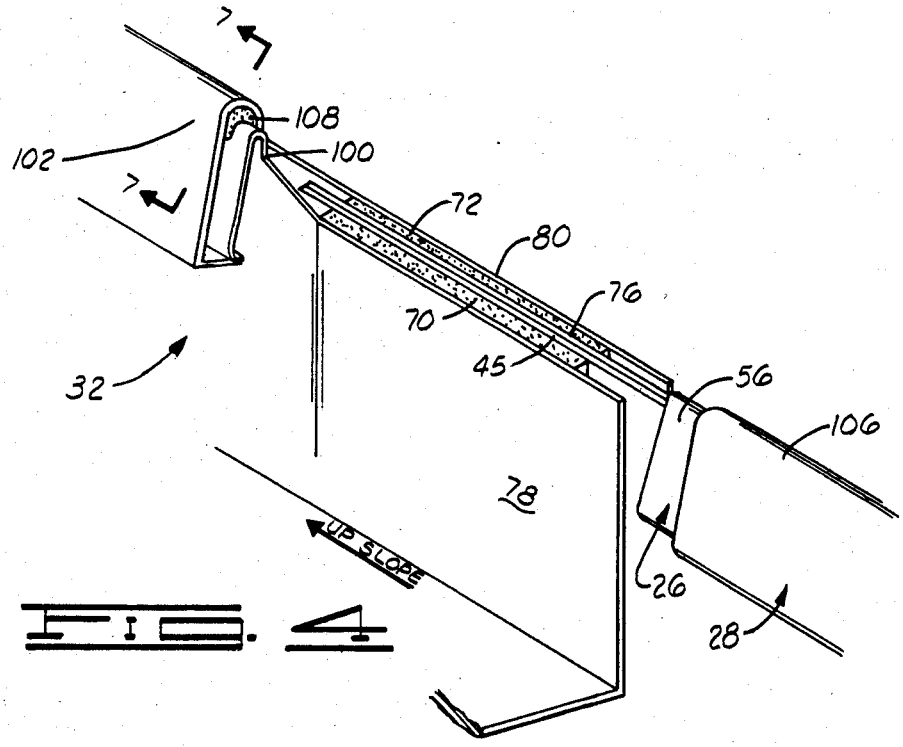
FIG. 4 an enlarged, partially broken isometric view showing a portion of a four-cornered junction of a standing seam A in FIG. 1.
Figure 5:
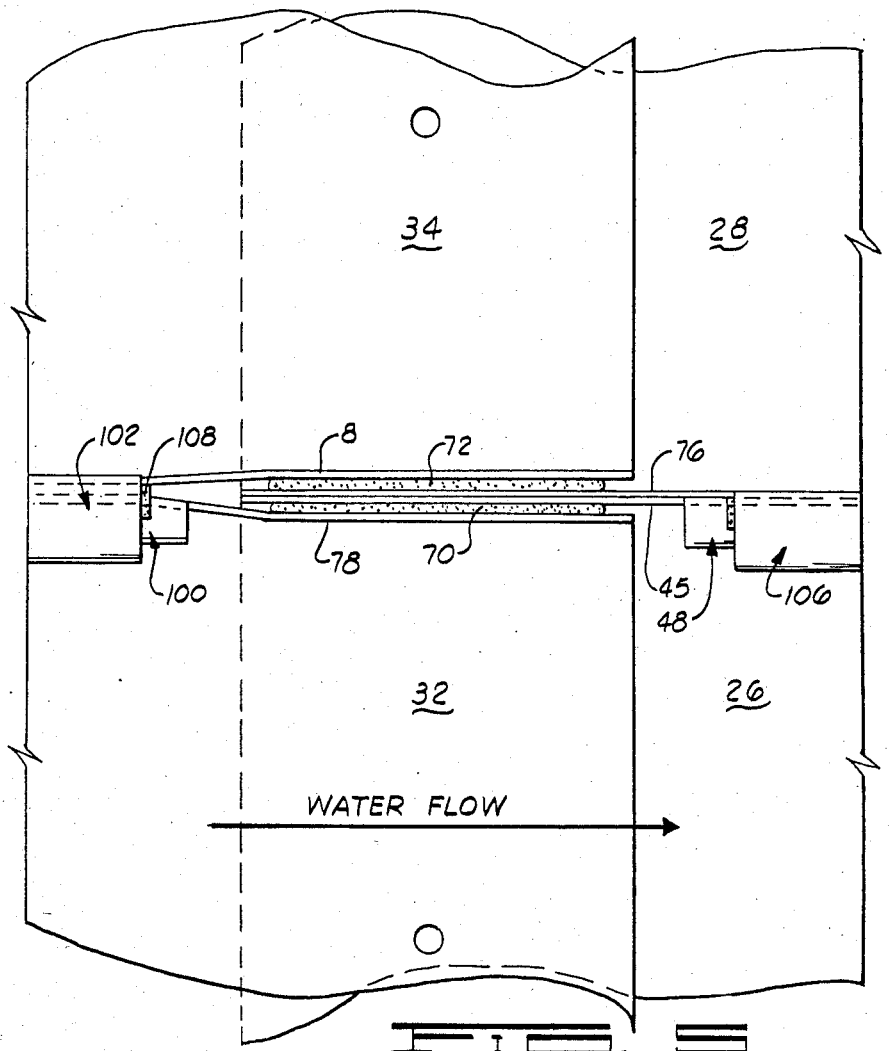
FIG. 5 is a partially broken plan view of the four-cornered junction of the standing seam of FIG. 4.

In an assembled position of the panels 26, 28, 32 and 34, a four cornered junction is formed, such junction being illustrated in FIGS. 3, 4 and 5. The mastic cup 82 containing the mastic 84 is clamped over the four corner junction to substantially seal same and provide a watertight junction. The upstanding portion 78 of the panel 32 is formed with a male connecting assembly 100 and the upstanding portion 80 of the panel 34 is formed with a female connecting assembly 102. Similarly, the upstanding portion 45 of the panel 26 formed with the male connecting assembly 56 and the upstanding portion 76 of the panel 28 is formed with a female connecting assembly 106. The male connecting assembly 56 of the panel 26, the female connecting assembly 106 of the panel 28, the male connecting assembly 100 of the panel 32, and the female connecting assembly 102 of the panel 34 terminate a selected distance from the end of each of the panel members so as to provide the recessed or notched portion in the ends thereof, such as the notched portion 52 and 60 formed in the panel 26 and as illustrated in FIG. 2. The relationships between the recessed portions or notches when the panels of the roof assembly 10 are assembled in the field is controlled by aligning and inserting a fastener through the factory punched holes in the endlap portion of the panels as heretofore described. As previously stated, in the construction of the roof assembly 10 illustrated in the drawings, the panels 26 and 28 are disposed adjacent to each other and extend to within the panels 32 and 34 as heretofore described. Further, the sealant strip 70 is placed between the panels 26 and 32 and the sealant strip 72 is placed between the panels 28 and 34. The mastic cup 82 covers the notched portion formed by the junction of the panels 26, 28, 32, and 34 and seals the entire assembly at such a four corner junction. The sealant strips 70 and 72 are exposed at that juncture as is a standing seam sealant 108 which protrudes slightly from a cavity formed between the male connecting assembly of a panel, such as the male connecting assembly 100 of the panel 32, and the female connecting assembly of a panel, such as the female connecting assembly 102 of the panel 34, when the male and female connecting assemblies of such panels are in an assembled position. Further, when the male and female connecting assemblies of the panel members are in the assembled position, the standing seam sealant 108, a resilient mastic material, is compressed and forced to protrude such that a watertight seal is formed between the interconnected male and female connecting assemblies of the panels. The protrusion of the standing seam sealant 108 from the cavity formed between the male and female connecting assemblies of the assembled panels enables the standing seam sealant 108 to contact the mastic 84 of the mastic cup 82 when the mastic cup 82 is in an assembled position and the mastic 84 contained therein is placed in a compressed condition.

The male and female connecting assemblies of the panels, such as the male connecting assembly 100 of the panel 32 and the female connecting assembly 102 of the panel 34, are constructed such that in an assembled position the male connecting assembly 100 protrudes slightly past the end of the female connecting assembly 102 substantially as shown in FIGS. 3, 4 and 5. The construction and interconnection of the male and female connecting assemblies of the panels and the mastic cup 82 (see FIG. 3) is such that upon positioning the mastic cup 82 in the notched or recessed portion formed between the adjoining end portions of the four panels, the mastic cup 82 engages the protruding male connecting assemblies of the endlapped panels and the standing seam sealant 108 is forced to contact the mastic 84 in the mastic cup 82 and the sealant strips 70 and 72 disposed between the overlapped end portions of the panels to form a watertight three corner joint. The joint is extended to a four corner watertight joint when mastic (not shown) between the male connecting assembly 56 of the panel 26 and the female connecting assembly 106 of the panel 28 is included and extruded.

Figure 7:
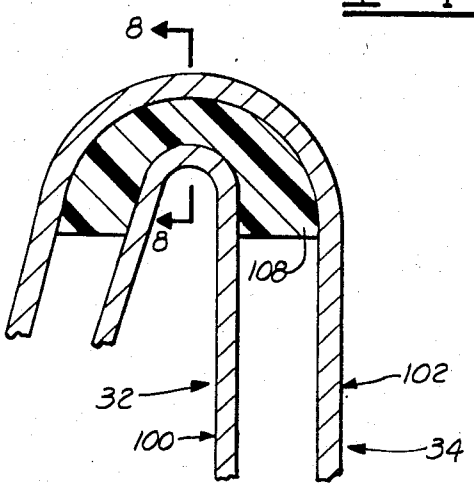
FIG. 7 is an enlarged, partial sectional view of the standing seam taken at 7—7 in FIG. 4.

Referring now to FIGS. 7 and 8, the end relationship of the standing seam sealant 108 and the male and female connecting assemblies 100, 102 of the panels 32, 34, respectively, is illustrated in detail. The standing seam sealant 108 is positioned within a male receiving cavity formed in an upper or apex portion of the female connecting assemblies of the panels forming the standing seam such that upon formation of a proper union between the male and female connecting assemblies the standing seam sealant 108 is compressed to form an effective watertight seal therebetween. The standing seams sealant 108 desirably will possess the following properties; adhesion, flexibility, water repellency and resiliency. Typical of a commercially available sealant which can be used as the standing seam sealant 108 is sold under the trademark "Q-41" by Q-SO, Inc., of Saginaw, Tex. The before-mentioned sealant is a blend of cross-linked ethylene-propylene terpolymer and other materials, such as plasticizer and antioxidants. However, it is understood that this sealant employed as the standing seam sealant 108 can be any suitable sealant provided it has the desired properties of adhesion, flexibility, water repellency and resiliency so that upon compression the sealant forms a gasket. Further, the standing seam sealant 108 is preferably a foamed mastic which has a substantially constant durometer. A constant durometer assures easy field assembly of the panels of the roof assembly 10 throughout a wide range of field temperatures.

Figures 9, 10, 11, 12:
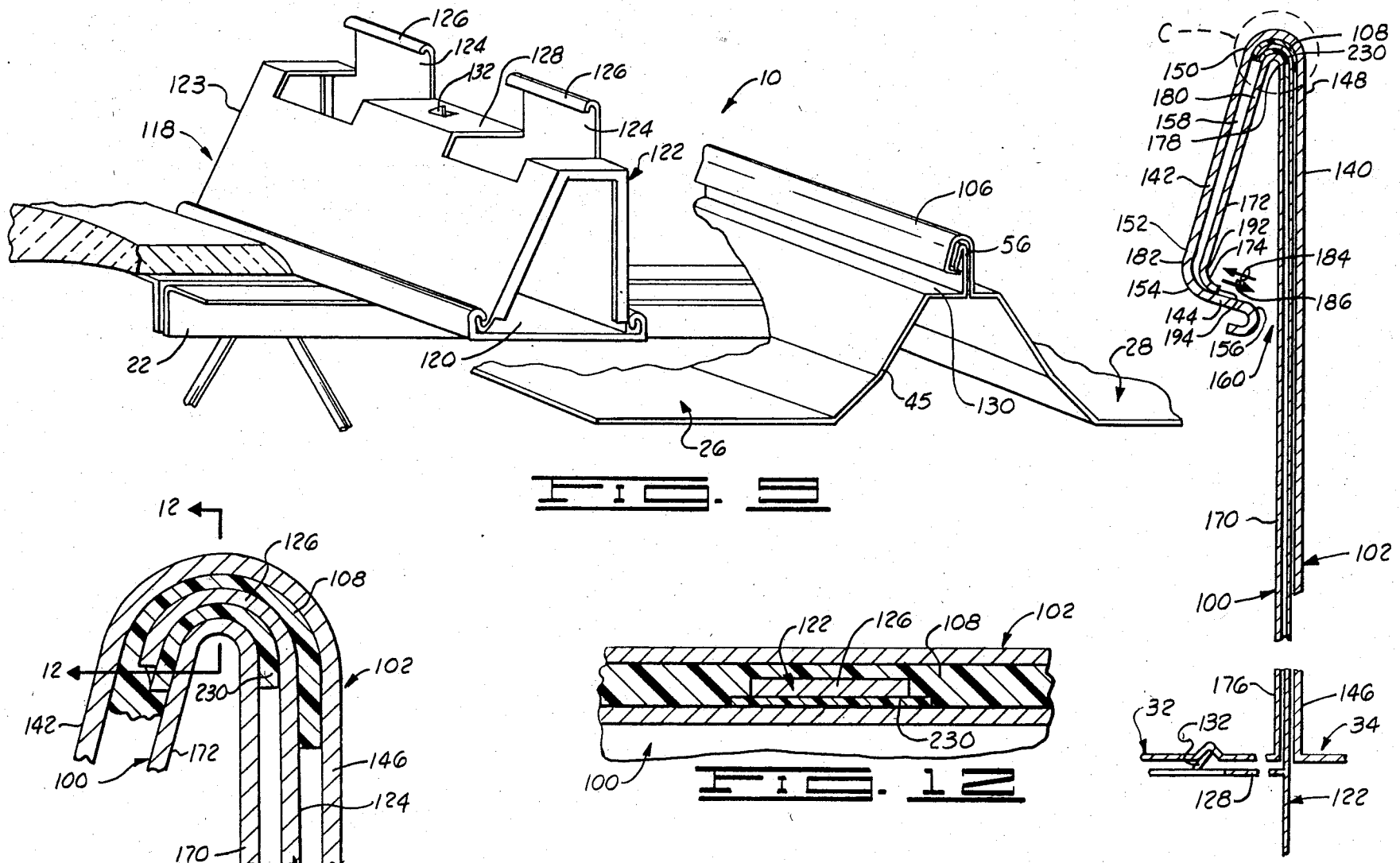
FIG. 9 a partially broken isometric view of the standing seam roof assembly of FIG. 1 represented by the area B and illustrating a clip for permitting the roof assembly to float.
FIG. 10 is an enlarged, fragmentary sectional view of the standing seam roof assembly taken at line 10—10 of FIG. 1 and illustrating a proper mating relationship of the male and female connecting assemblies of adjacently disposed panels forming the standing seam with a clip.
FIG. 11 is an enlarged, partially broken, cross-sectional view of the standing seam of the standing seam roof assembly of FIG. 10 represented by the area C.
FIG. 12 is a fragmentary sectional view of the standing seam taken at line 12—12 of FIG. 11.

Referring now to FIG. 9, the roof assembly 10 further includes a clip assembly 118 which comprises a base member 120 and a clip member 122. The base member 120 is secured to the joist 22 by any suitable means, and the clip member 122 is slidably mounted in the base member 120. The clip member 122 comprises a web member 123, a pair of upwardly extending portions 124 having curved end portions 126 and a horizontally disposed portion 128 positioned between the upwardly extending portions 124. The upstanding portion of each of the panels, such as the upstanding portion 45 of panel 26, is provided with a substantially horizontal portion 130 adapted to seat upon the substantially horizontal portion 128 of the clip member 122. The substantially horizontal portions 130 and 128 of the panel 26 and the clip member 122 cooperate to support the male connecting assembly 56 of the panel 26 while the female connecting assembly 106 of the panel 28 is forced over the male connecting assembly 56 and into a proper mating relationship. The support of the male connecting assembly of each panel, such as the male connecting assembly 56 of the panel 26, is especially critical at clip assembly 118 locations in that the curved end portions 126 of the clip members 122 must compress the standing seam sealant and be imbedded in it while permitting the female and male connecting assemblies of adjacent panels, such as the male connecting assembly 56 of the panel 26 and the female connecting assembly 106 of the panel 28 to enter into the proper mating relationship. The horizontal portion 128 of the clip member 122 is provided with a projection 132 adapted to bite into the horizontal portion 130 of the upstanding portion 45 of the panel 26. Thus, when the panels are assembled, the projection 132 bites into the horizontal portion 130 of the panel 26 and prevents the panel 26 from moving relative to the clip member 122 formed integrally with the web member 123 and the upwardly extending portions 124 of the clip member 122 housed between the standing seam assembly.

Figure 14:
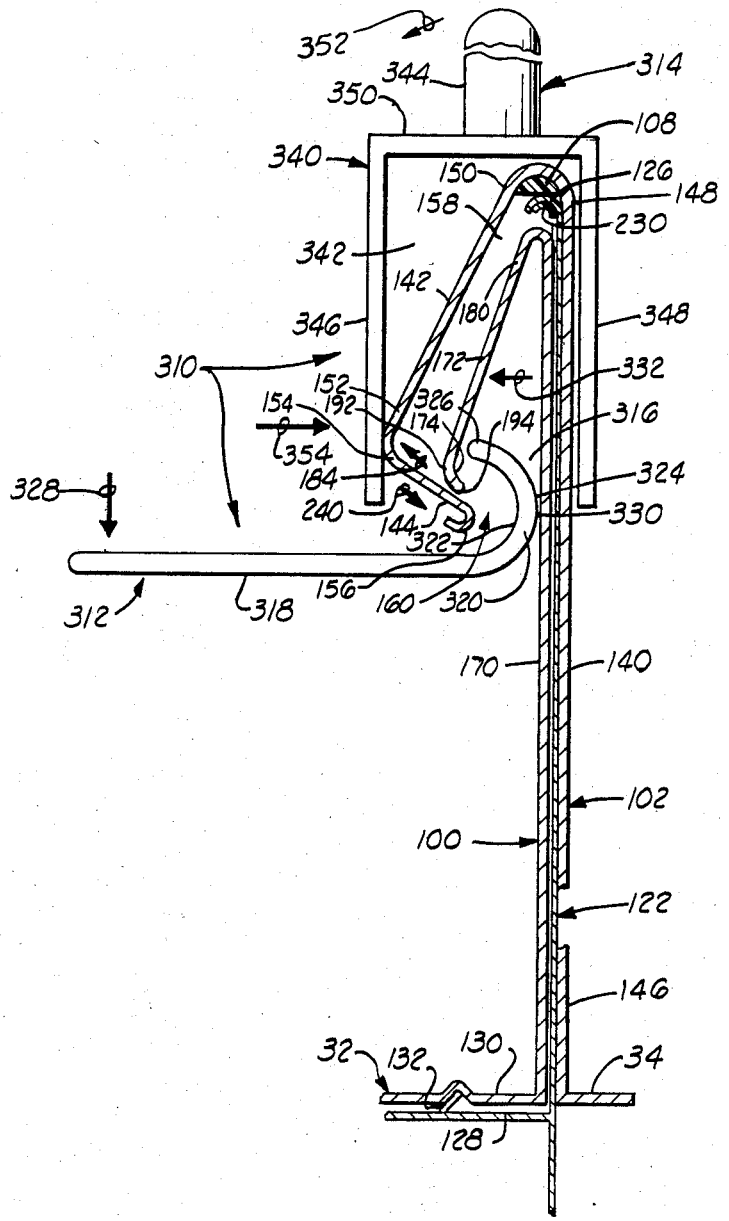
FIG. 14 is an enlarged, partially broken, cross-sectional view of a standing seam wherein the male and female connecting assemblies of the panels forming the standing seam are improperly joined and illustrating an apparatus for correcting the relationship of the male and female connecting assemblies to insure joint integrity therebetween

Referring now to FIGS. 10 and 14, the interconnection of the female connecting assembly 102 of the panel 34 and the male connecting assembly 100 of the panel 32 to form the standing seam of the roof assembly 10 is illustrated. The female connecting assembly 102 of the panel 34, and thus the female connecting assembly of each panel, comprises a first leg member 140, a second leg member 142 and a lip member 144. The first leg member 140, which extends along a substantial portion of the upstanding portion defining one side of the panel is provided with a first end 146 and a second end 148. The first end 146 of the first leg member 140 is disposed along the upstanding portion of the panel so that the first leg member 140 of the female connecting assembly 102 is substantially normally disposed to the plane of the body portion of the panel. The second leg member 142 of the female connecting assembly 102, which corresponds substantially in length to the first leg member 140, is provided with a first end 150 and a second end 152. The lip member 144 of the female connecting assembly 102 likewise substantially corresponds in length to the first and second leg members 140, 142 and is characterized as having a first end 154 and a second end 156. The first end 150 of the second leg member 142 is connected to the second end 148 of the first leg member 140 such that the second leg member 142 and the first leg member 140 cooperate to form an acute angle therebetween; and the first end 154 of the lip member 144 is connected to the second end 152 of the second leg member 142 so as to be substantially normally disposed to the second leg member 142 such that the lip member 144 extends in the direction of the first leg member 140. Thus, the interconnection of the first leg member 140, the second leg member 142, and the lip member 144 defines a male assembly receiving cavity 158 having an opening 160 in a lower portion for insertion for one of the male assemblies. Further, the interconnection of the first and second leg members 140, 142 define an apex in an upper portion of the male assembly receiving cavity 158; and the interconnection of the second leg member 142 and the lip member 144 partially restrict a lower portion of the male assembly receiving cavity 158 such that the opening 160 is defined by the second end 156 of the lip member 144 and the first leg member 140. As previously stated, the lip member 144 is disposed substantially normal to the second leg member 142. Thus, the lip member 144 is provided with an incline from its second end 156 to its first end 154.

The male connecting assembly 100 of the panel 32, and thus the male connecting assembly of each panel, is adapted to be positioned within the male assembly receiving cavity of the female connecting assembly, such as the male receiving cavity 158 of the female connecting assembly 102. Each of the male connecting assemblies, such as the male connecting assembly 100, comprises a third leg member 170, a fourth leg member 172 and lip engaging member 174. The third leg member 170 extends along a substantial portion of the upstanding portion defining an adjacently disposed side of the panel 32 so that the third leg member 170 is substantially normally disposed to the body portion of the panel 32 and substantially parallel to the first leg member 140 of the female connecting assembly 102 of the adjacently disposed panel 34. The length of the male connecting assembly 100 is greater than the length of the female connecting assembly 102 so that when the two adjacently disposed panels are overlapped via their adjacently disposed ends a notch or recessed portion is formed and the male connecting assembly 102 supports the mastic cup 82 which covers the notched or recessed portion formed by the junction of the panels as heretofore described.

The third leg member 170 is provided with a first end 176 and a second end 178. The first end 176 of the third leg member 170 is connected to the upstanding portion disposed along one side of each of the panels, such as the upstanding portion disposed along the second side of the panel 32, so that the third leg member 170 is substantially normally disposed to the plane of the body portion of the panel 32 and substantially parallel to the first leg member 140 of the female connecting assembly 102. The fourth leg member 172, which is also provided with a first end 180 and a second end 182 and having a length substantially corresponding to the length of the third leg member 170, is connected to the second end 178 of the third leg member 170 via the first end 180 such that the fourth leg member 172 extends from the third leg member 170 and forms an acute angle with the third leg member 170. Desirably, the resulting shape of the male connecting assembly 100 formed by the junction of the third and fourth leg members 170, 172 substantially corresponds to the shape of the male assembly receiving cavity 158 formed in the female connecting assembly 102.

The lip engaging member 174 of the male connecting member 100 is formed on the second end 182 of the fourth leg member 172. Upon positioning the male connecting member 100 into the male assembly receiving cavity 158 of the female connecting member 102 to form the standing seam joint by the union of the male and female connector assemblies 100, 102, the lip engaging member 174 slidingly moves along the lip member 144 of the female connecting assembly 102 in a first direction represented by the arrow 184 towards the second leg member 142 of the female connecting assembly 102. When the male connecting assembly 100 has been properly positioned within the female assembly receiving cavity 158 of the female connecting assembly 102, and a force is applied to the two panel members forming the standing seam joint (such as when the adjacently disposed, connected panels expand, contract, and are subjected to load and stress), the lip engaging member 174 bites or digs into the lip member 144 of the female connecting assembly 102 and resists movement in a second direction represented by the arrow 186 away from the second leg member 142 of the female connecting assembly 102. Thus, the lip engaging member 174 of the male connecting assembly 100 and the lip member 144 of the female connecting assembly 102 cooperate such that in an assembled position of the male and female connecting assemblies 100, 102, the lip engaging member 174 and the lip member 144 prevent undesirable separation of the male and female connecting assemblies 100, 102.

The lip engaging member 174 of the male connecting assembly 100 is an arcuate shaped member having a first end 192 and a second end 194. The first end 192 of the lip engaging member 174 is connected to the second end 182 of the fourth leg member 172 of the male connecting assembly 100 such that the second end 194 extends in the direction of the third leg member 170 and is adapted to engage the lip member 144 of the female connecting assembly 102 when the male connecting assembly 100 is inserted into the male assembly receiving cavity 158 of the female connecting assembly 102. The second end 194 of the lip engaging member 174 is provided with a sharp edge or point which is adapted to be slidably moved over the lip member 144 of the female connecting assembly 102 in the direction of the arrow 184, and will engage the lip member 144 when a force is applied to the panel members which would tend to cause the lip engaging member 174 to move in the direction of the arrow 186. Thus, the lip engaging member 174 of the male connecting assembly 100 of the panel 32 can ride up the incline of the lip member 144 of the female connecting assembly 102 as the male connecting assembly 100 is disposed within the male assembly receiving cavity 158 of the female connecting assembly 102 and the panels 32 and 34 are snapped together. Because the second end 194 of the lip engaging member 174 is substantially in contact with the lip member 144 of the female connecting assembly 102 for a substantial portion of the length of the lip member 144 a uniform pressure is brought to bear against the standing seam sealant 108 disposed within the upper portion or apex of the male assembly receiving cavity 158. This coordinated action drives the upper end or the apex of the male connecting assembly 100 of the panel 32 against the standing seam sealant 108 disposed within the upper end or the apex of the female connecting assembly 102 of the panel 34 and creates a substantially uniform pressure against the standing seam sealant 108 for the full length of the adjoined sidelap. The arrangement is such that, when the male and female connecting assemblies 100, 102 of the panels 32, 34, respectively, are snapped together, the female connecting assembly 102 of the panel 34 is forced to a spread or open position when receiving the male connecting assembly 100, and the female connecting asembly snaps back to its original position once the male connecting assembly 100 is in a proper mating relationship with the female connecting assembly 102. This action, confined with the lip member 144 of the female connecting assembly 102, exerts spring pressure upwardly against the lip engaging member 174 of the male connecting assembly 100 of the panel 32. The force exerted against the lip engaging member 174 of the male connecting assembly 100 may be increased by forcing the lip engaging member 174 further up the incline of the lip member 144. This action insures clamping of the standing seam sealant 108 against the curvatures of the male and female connecting assemblies 100, 102 substantially as shown in FIGS. 4, 7, 8, 10, 11 and 12.

It should be understood that the configuration of the female connecting assembly 102 and the male connecting assembly 100 may vary as long as the spring action forces the apex of the male connecting assembly 100 into the standing seam sealant 108 as the lip engaging member 174 of the male connecting assembly 100 slides up a lip member 144 of the female connecting assembly 102.

Figure 13A:
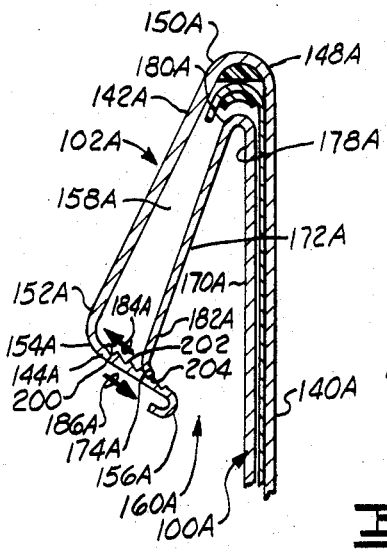
FIG. 13A is an enlarged, partially broken, cross-sectional view of a standing seam wherein the male and female connecting assemblies of the panels forming the standing seam are improperly joined, and illustrating a modified lip member of the female connecting assembly adapted to lockingly engage the lip engaging members of the male connecting assembly when same are in an assembled position.

Referring now to FIG. 13A, the interconnection of a female connecting assembly 102A and a male connecting assembly 100A to form the standing seam roof seam of a roof assembly is illustrated. The female connecting assembly 102A comprises a first leg member 140A, a second leg member 142A and a lip member 144A. The first leg member 140A, which is substantially identical in construction and configuration to the first leg member 140 of the female connecting assembly 102 heretofore described with reference to FIG. 10, is substantially normally disposed to the body portion of a panel and is provided with a first end (not shown) and a second end 148A. The second leg member 142A, which corresponds substantially in length to the first leg member 140A along the panel, is provided with a first end 150A and a second end 152A. The lip member 144A of the female connecting assembly 102A substantially corresponds in length along the panel to the first and second leg members 140A, 142A and is characterized as having a first end 154A, a second end 156A, and an upper side 200. The first end 150A of the second leg member 142A is connected to the second end 148A of the first leg member 140A such that the second leg member 142A and the first leg member 140A cooperate to form an acute angle therebetween; and the first end 154A of the lip member 144A is connected to the second end 152A of the second leg member 142A so as to be substantially normally disposed to the second leg member 142A such that the lip member 144A extends in the direction of the first leg member 140A. The interconnection of the first leg member 140A, the second leg member 142A and the lip member 144A defines a male assembly receiving cavity 158A having an opening 160A in a lower portion for insertion of one of the male assemblies. Further, the interconnection of the first and second leg members 140A, 142A define an apex in an upper portion of the male assembly receiving cavity 158A; and the interconnection of the second leg member 142A and the lip member 144A partially restrict a lower portion of the male assembly receiving cavity 158A such that the opening 160A is defined by the second end 156A of the lip member 144A and the first leg member 140A. The lip member 144A extends from the second leg member 142A so that the lip member 144A, and thus the upper side 200 thereof, is provided with an incline from the second end 156A to the first end 144A.

A plurality of spatially disposed tooth-like stop members 202 are formed along the upper side 200 of the lip member 144A. The resilient nature of the second leg member 142A and the lip member 144A of the female connecting assembly 102A enables one to position a male connecting assembly 100A within the male assembly receiving cavity 158A of the female connecting assembly 102A so that a portion of the male connecting assembly 100A can be slidably moved along the upper side 200 of the lip member 144A in a first direction represented by the arrow 184A to establish a proper mating relationship between the male and female connecting assemblies 100A and 102A. Further, the tooth-like stop members 202, after the male connecting assembly 100A has been properly disposed within the male assembly receiving cavity 158A, prevent the disengagement of the male connecting assembly 100A from the female connecting assembly 102A by substantially restricting movement of a lip engaging member 174A of the male connecting assembly 100A along the lip member 144A in a second direction represented by the arrow 186A.

The male connecting assembly 100A comprises a third leg member 170A, a fourth leg member 172A and the lip engaging member 174A. The third leg member 170A extends along one side of each of the panels so as to be substantially oppositely disposed to the first leg member 140A of the female connecting assembly 102A; and the third leg member 170A of the male connecting assembly 100A is substantially normally disposed to the body portion of the panel and substantially parallel to the first leg member 140A of the female connecting assembly 102A. The third leg member 170A of the male connecting assembly 100A extends along a substantial portion of the side of the panel such that the overall length of the male connecting assembly 100A is greater than the length of the female connecting assembly 102A as heretofore described with reference to the male and female connecting assemblies 100 and 102.

The third leg member 170A of the male connecting assembly 100A is provided with a first end (not shown) and a second end 178A. The first end (not shown) of the third leg member 170A is connected to the upstanding portion disposed along one side of each of the panels such that the third leg member 170A is substantially normally disposed to the plane of the body portion of the panel and substantially parallel to the first leg member 140A of the female connecting assembly 102A. The fourth leg member 172A, which is also provided with a first end 180A and a second end 182A and having a length substantially corresponding to the length of the third leg member 170A, is connected to the second end 178A of the third leg member 170A via the first end 180A such that the fourth leg member 172A extends from the third leg member 170A and forms an acute angle with the third leg member 170A. Desirably, the resulting shape of the male connecting assembly 100A formed by the junction of the third and fourth leg member 170A, 172A coordinate with the shape of the male assembly receiving cavity 158A formed in the female connecting assembly 100A. The lip engaging member 174A of the male connecting member 100A, an arcuate shaped member, is formed on the second end 182A of the fourth leg member 172A so as to be disposed in a downwardly sloping direction substantially as shown. Thus, upon positioning the male connecting member 100A into the male assembly receiving cavity 158A of the female connecting member 102A to form the standing seam joint by the union of the male and female connector assemblies 100A, 102A, the lip engaging member 174A slidably moves along the upper side 200 of the lip member 144A of the female connecting assembly 102A in the first direction represented by the arrow 184A. The resilient nature of the lip member 144A and the upward movement of the male connecting assembly 100A into the male assembly receiving cavity 158A of the female connecting assembly 102A allows the lip engaging member 174A to slide over the tooth-like stop members 202 disposed along the upper side 200 of the lip member 144A. When the male connecting assembly 100A has been properly positioned within the male assembly receiving cavity 158A of the female connecting assembly 102A, and a force is applied to the two panel members forming the standing seam joint (such as when the adjacently disposed, connected panels expand, contract and are subjected to load and stress), a distal end 204 of the lip engaging member 174A engages the tooth-like stop members 202 on the upper side 200 of the lip member 144A to resist movement of the lip engaging member 174A in the direction represented by the arrow 186A. Thus, the lip engaging member 174A of the male connecting assembly 102A, and the tooth-like stop members 202 formed on the lip member 144A of the female connecting assembly 102A cooperate such that in an assembled position of the male and female connecting assemblies 100A, 102A, the lip engaging member 174A and lip member 144A prevent undesirable separation of the standing seam, thereby maintaining joint integrity once these members are assembled.

The shape of the lip engaging member of the male connecting assembly, and the degree of inclination of the lip member of the female connecting assembly will depend on the geometry of the standing seam joint. However, regardless of the geometry of the standing seam joint, the male and female connecting assemblies forming the joint should be configured such that the distance between the upper end or apex of the male connecting member and the lower center surface of the mastic disposed in the apex, or upper portion, of the female connecting assembly diminishes as the lip engaging member of the male connecting assembly proceeds up the inclination of the lip member of the female connecting assembly. This results in a substantially uniform pressure being exerted on the mastic disposed within the apex portion of the female connecting assembly throughout the length of the joint via the union of the male and female connecting assemblies, and thus substantially eliminates voids and uneven distribution of the mastic in the standing seam joint. This feature compensates for differing amounts of mastic in the apex of the female connecting assembly, as well as compensating for mastics having varying durometer values, the result being positive mastic compression and joint engagement over widely variable conditions. Further, this feature permits the intrusion of the upper ends 126 of the clips 122 at spaced intervals along the seam while maintaining a uniform watertight seal throughout the length of the seam.

The slope of the lip member desirably is such that the wedge provided thereby amplifies the force applied to the male member to seat it in the mastic in the apex of the female member; that is, the force urging the lip engaging member up the lip member is multiplied because of the mechanical advantage gained as a result of the incline. It is believed that this inclination, in order to achieve this added beneficial result, should be less than about 45 degrees from horizontal.

Figure 13B:
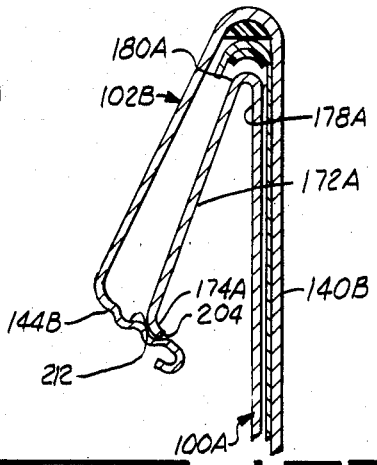
FIG. 13B is an enlarged, partially broken, cross-sectional view of a standing seam wherein the male and female connecting assemblies of the panels forming the standing seam are improperly joined, and illustrating a modified lip member of the female connecting assembly adapted to lockingly engage the lip engaging member of the male connecting assembly when same are in an assembled position.
Figure 13C:
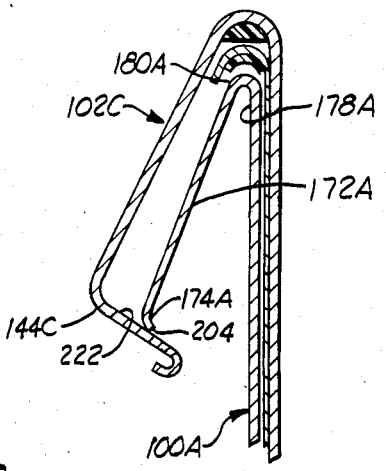
FIG. 13C is an enlarged, partially broken, cross-sectional view of a standing seam wherein the male and female connecting assemblies of the panels forming the standing seam are improperly joined, and illustrating a modified lip member of the female connecting assembly adapted to lockingly engage the lip engaging member of the male connecting assembly when same are in an assembled position.
Figure 5:
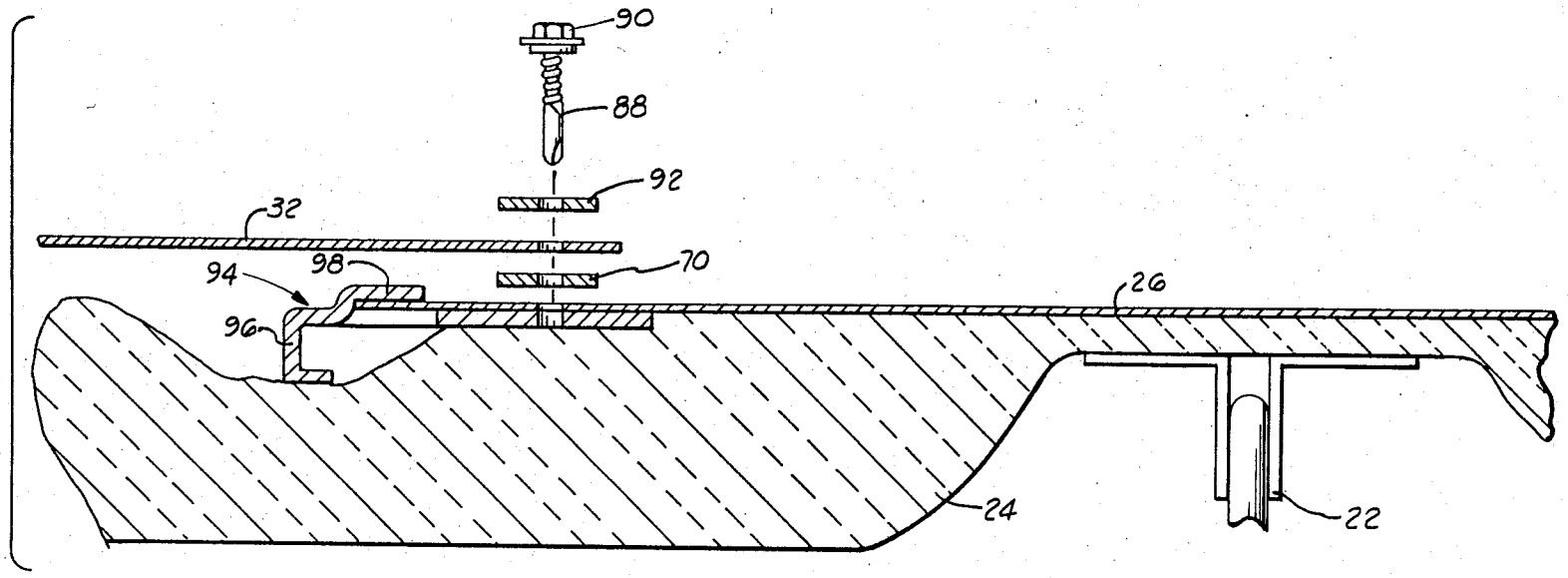

FIGS. 13B and 13C illustrate the interconnection of modified female connecting assemblies 102B and 102C with the male connecting assembly 100A. The discussion of FIG. 13A is, for the most part, applicable to the assemblages of FIGS. 13B and 13C except as will now be described. For clarity, identical numbers are used in FIGS. 13B and 13C to those used in FIG. 13A where the components are identical. With reference to FIG. 13B, illustrated therein is the female connecting assembly 102B which is identical to the female connecting assembly 102A (illustrated in FIG. 13A) except for the lip member 144B. In lieu of the tooth-like stop members 202, the lip member 144B has a corrugated or wave like configuration so that a plurality of spatially disposed stop members 212 are formed along the lip member 144B. In FIG. 13C, the female connecting assembly 102C, also identical to the previously described female connecting assembly 102A except for the lip member 144C. Instead of having stop members formed along the upper side of the lip member 144C, the same frictional result is achieved by reducing the curvature of the distal end 204 of the lip engaging member 174A to increase the frictional bite between the lip engaging member 174A and the upper surface of the lip member 144C. If desired, the upper surface of the lip member 144C can be roughened, such as by an abrating process, to increase this frictional bite. It will be appreciated that the operational characteristics of the embodiments illustrated in FIGS. 13B and 13C are essentially the same as described hereinabove for that illustrated in FIG. 13A so further description is believed unnecessary for the present disclosure.

Referring now to FIGS. 9, 10, 11 and 12, the clip member 122 of the clip assembly 118 extends upwardly between the male and female connecting assemblies of adjacent panels forming the standing seam portion of the roof assembly, such as the male and female connecting assemblies 100, 102 of the panels 32 and 34, so that the curved end portion 126 of the upwardly extending portion 124 of the clip member 122 curve around the upper or apexed portion of the male connecting assembly 100 of the panels. Sealant, such as tape 230, is positioned between the curved end portions 126 of the upwardly extending portion 124 of the clip member 122 and the curved upper or apex portion of the male connecting member 100 of the panel 32 substantially as shown in FIG. 10. The arrangement is such that the curved end portion 126 of the upwardly extending portion 124 of the clip member 122 is encapsulated by the standing seam sealant 108 and the tape 230 when the male and female connecting assemblies 100, 102 are in a proper union.

In forming the standing seam metal floating roof assembly, self-tapping screws and resilient washers, such as screw 88 and neoprene washer 92 (illustrated in FIGS. 2 and 5) are employed. Prevention of relative motion between the clip member 122 and the panels forming the standing seam, (such as the panels 32 and 34) in combination with the unique design of the male and female connecting assemblies 100, 102 forming the standing seam, overcome the working, kneading or degrading of the standing seam sealant 108. Further, the unique construction of the standing seam metal floating roof assembly, when properly installed, enables all sealants to be kept under constant uniform pressure and dirt is prevented from reaching past the outside line of the sealants.

It will be further observed that, whenever sealant is applied, dirt, oil or film may intervene between the sealant and the panel itself. Thus, it is preferable to use a sealant in the form of mastic tapes having not only adhesion but resiliency. The placing of the mastic or sealant at the point of clip rotation allows the panels to be assembled, when they are snapped together via the union of the male and female connector assemblies 100, 102, in such a manner that the sealant or mastic is not dislodged. Furthermore, this sealant has a tendency to become compressed because of repeated roof live loads, such as workers walking on the roof, snow and the like. With the advent of low-pitched roofs, it is more common for persons to walk on the roof. Furthermore, snow and ice tend to stay on the roof to a much greater extent that with the higher-pitched roofs formerly used. Under these conditions, the sealant function becomes extremely important in the life of the roof. The thickness of the mastic or sealant tape should be sufficient to resist movement caused by expansion and contraction and various live load conditions without rupturing.

The improved standing seam floating roof assembly described above provides a sidelap joint for adjacent panels of the standing seam roof in which a resilient sealant is clamped under spring pressure between male and female connecting assemblies of the panel members, as well as an endlap joint between adjacent panels in which a sealant is clamped between the upper and lower panels. The four corner assembly enables one to seal the standing seam roof at this junction and insure that no leakage will occur. Further, the clip for holding the metal roof to the secondary structural members enables the roof to float relative to the secondary structural members while preventing relative motion between the roof assembly and the clip.

The standing seam roof assembly described above overcomes many of the disadvantages of the prior art roof assemblies. However, problems may nevertheless be encountered in the erection of the roof assembly due to human error, imperfections in the components as manufactured or as a result of damage to the components during shipping and erection of the roof assembly. For example, a proper insulation of the standing seam of the roof assembly is illustrated in FIG. 10 of the drawing wherein the lip engaging member 174 of the male connecting assembly 100 has been forced to slidably move along the lip member 144 of the female connecting assembly 102 so that the male connecting assembly 100 is disposed in a proper relationship within the male assembly receiving cavity 158 of the female connecting assembly 102. A proper union between the male and female connecting assemblies 100, 102 of the adjacent panels 32, 34 insures proper sealing of the male connecting assembly 100 with the standing seam sealant 108 disposed in the upper or apex end of the female connecting assembly 102 as shown in FIGS. 10, 11 and 12. However, in actual practice, the imperfections or defects in the fabrication of the various components may result in improper union between the male and female connecting assemblies of adjacent panels forming the standing seams. An improper union between adjacent panels forming the standing seam of the roof assembly results in uneven distribution of pressure against the standing seam sealant which often results in leaks in the roof assembly. Further, improper installation of the standing seam of the roof assembly may also result in separation of adjacent panels, especially when the adjacent panels are subjected to differential loads as may be encountered when one panel expands or contracts differently than an adjacent panel, or when uplift loads from the wind is encountered. The separation may occur when the lip engaging member 174 of the male connecting assembly 100 is not in sufficient contact with the lip member 144 of the female connecting assembly 102 so that as the panel members are caused to move up and down due to varying loads the panels separate and the mastic seal between the male connecting assembly 100 and the female connecting 102 is broken.

Referring now to FIG. 14, a standing seam of the roof assembly 10 is illustrated where an improper union between the male and female connecting assemblies of adjacent panels is formed, such as the union between the male and female connecting assemblies 100, 102 of the panels 32 and 34, respectively. The defective union between the male and female connecting assemblies of the standing seam is caused because the lip engaging member 174 of the male connecting assembly 100 has not travelled up the incline of the lip member 144 of the female connecting assembly 102 a sufficient distance to insure that the apex of the male connecting assembly 100 contacts the standing seam sealant 108 disposed in the apex of the female connecting assembly 102. Further, the male connecting assembly 100 of the panel 32 does not engage the tape 230 contained within the curved end portion 126 of the clip member 122 to form a seal therebetween as heretofore discussed. When the male and female connecting assemblies 100, 102 of the panels 32 and 34 are not properly joined, leaks in the roof assembly can readily occur. This imperfection can also result in complete physical separation of the male and female connecting assemblies 100, 102 when the panels forming the standing seam are subjected to oppositely directed forces.

The improper union between adjacently disposed panels forming the standing seam, such as the union between the male and female connecting assemblies 100, 102 of the panels 32, 34 can be the result of imperfection in the components as manufactured, and excess of standing seam sealant 108 in the upper or apex portion of the female connecting assembly 102 of the panel 34, damage to the components in shipping and handling, human error in the assembly of the standing seam roof assembly and the like. In addition, even when the male and female connecting assemblies of the adjacent panels are properly joined problems may be encountered because of the length of the panel members forming the standing seam roof. For example, even when the male and female connecting assemblies are properly joined to form the standing seam a wave-like characteristic may be developed along the length of the standing seam portion of the panel. The wave-like characteristic may also make the standing seam of the roof assembly subject to leaks. Thus, in the assembly of the standing seam roof it is desirable that the standing seam be adjusted to substantially eliminate the wave-like characteristic and to insure that the standing seam sealant 108 is distributed substantially uniformly throughout the length of the standing seam and that a substantially constant pressure is exerted on the standing seam sealant 108 by the union of the male and female connecting assemblies 100 and 102.

In constructing the standing seam of the floating roof assembly the male and female connecting assemblies of two adjacently disposed panels, such as the male and female connecting assemblies 100 and 102 of the panels 32 and 34 are joined by inserting the male connecting member 100 into the male assembly receiving cavity 158 of the female connecting assembly 102 via the opening 160 so that the second end 194 of the lip engaging member 174 of the male connecting assembly 100 engages and is supported by the lip member 144 of the female connecting assembly 102. As male connecting assembly 100 is inserted into the female connecting assembly 102 both flex, i.e., the male connecting assembly 100 is compressed while the female connecting assembly 102 is opened. As lip engaging member 174 moves over the lip member 144 the effect of friction between the two must be overcome. There are instances in which the spring action of the assembly is insufficient to overcome the frictional force and the assembly is improperly seated. Because of the spring like nature of the male and female connecting assemblies 100 and 102, and the compressed state of the male connecting assembly 100 as it is inserted into the male receiving cavity 158 via the opening 160, the lip engaging member 174 and the fourth leg member 172 of the male connecting assembly 100 will slidably move up the incline of the lip member 144 of the female connecting assembly 100 in the direction indicated by the arrow 184 until the assembly reaches equilibrium with the apex of the male connecting assembly 100 bearing firmly against the standing seam mastic 108 disposed in the apex of the female connecting assembly 102. The combined movement of the lip engaging member 174 of the male connecting assembly 100 along the inclined lip member 144 of the female connecting assembly 102 and the fourth leg member 172 (in the direction indicated by the arrow 184), and the movement of the second leg member 142 of the female connecting assembly 102 (in the direction represented by the arrow 240 because of its resilient characteristics), will cause the male connecting assembly 100 to move upwardly into the male assembly receiving cavity 158 of the female connecting assembly 102 and into proper seating engagement with the tape 230, the curved end portions 126 of the clip member 122 and the standing seam sealant 108 disposed in the apex or upper portion of the female connecting assembly 102 substantially as shown in FIG. 10 and 11.

As repeated inwardly directed load is brought to bear on panel 26 the female connecting assembly 102 will be forced down against the male connecting assembly 100. This will tend to compress the standing seam sealant 108 and reduced friction between the inclined lip member 144 of the female connecting assembly 102 and the second end 194 of the lip engaging member 174 of the male connecting assembly 100, in combination with the residual spring action of the second leg member 142 and the inclined lip member 144 of the female connecting assembly 102 and the fourth leg member 172 and the lip engaging member 174 of the male connecting assembly 100 will move the lip engaging member 174 further up the inclined lip member 144 resulting in a progressively more secure joint.

In certain instances the resilient characteristics of the male and female connecting assemblies 100 and 102 will not be sufficient to slidably move the lip engaging member 174 of the first connecting assembly 100 up the inclined lip member 144 of the female connecting assembly 102 such that a proper union is formed between the male and female connecting assemblies 100, 102. This situation can occur in those instances where an excess of the standing seam sealant 108 has been disposed in the upper or apex portion of the female connecting assembly of the panel such as the female connecting assembly 102 of the panel 34, when the clip assembly spearate or is inserted between male and female connecting assemblies 100, 102, or when the male or female connecting assemblies 100, 102 have been sprung or otherwise damaged. In such instances, once the male connecting assembly 100 has been inserted into the male assembly receiving cavity 158 of the female connecting assembly 102, a force can be applied to the downwardly extending fourth leg member 172 of the male connecting assembly 100 so that the second end 194 of the lip engaging member 174 of the male connecting assembly 100 is slidably moved along the lip member 144 of the female connecting assembly 102 in the direction of the arrow 184 (i.e. in a direction away from the upstanding first leg member 140 of the female connecting assembly 102 and the third leg member 170 of the male connecting assembly 100). The application of force to the fourth leg member 172 of the male connecting assembly 100 urges the male connecting assembly 100 upwardly into the male assembly receiving cavity 158 of the female connecting assembly 102 so that a proper union is formed between the male and female connecting assemblies 100, 102.

An improper union between adjacently disposed male and female connecting assemblies of panels forming the roof assembly, such as the male assembly 100 of the panel 32 and the female connecting assembly 102 of the panel 34, as well as the inherent problems in the standing seam of the roof assembly due to the wave-like characteristics often present in an assembled standing seam roof assemlby can be overcome by employing an apparatus 310 illustrated in FIGS. 14, 15, 16 and 17.

The apparatus 310 comprises a first hand implement 312 and a second hand implement 314. In many instances the first hand implement 312 can be employed independent of the second hand implement 314 for correcting an improper union between the male and female connecting assemblies of adjacently disposed panels forming the standing seam. Further, the first hand implement 312 can be positioned within a recessed portion or cavity 316 formed in the male connecting assembly, such as the male connecting assembly 100 of the panel 32 (shown in FIGS. 14 and 17) so that on movement of the first hand implement 312 along the length of the standing seam formed between the adjoined male and female connecting assemblies the wave-like characteristics and imperfections which may be present within the standing seam are readily identified and/or corrected and the integrity of the standing seam joint is substantially enhanced because the standing seam sealant 108 will be substantially uniformly distributed and compressed along the length of the standing seam of the building roof. Further, by the unique construction of the male and female connecting assemblies, such as the male connecting assembly 100 and the female connecting assembly 102, the resulting joint will have an increased resistance to sliding as forces are applied to the panels once the proper union of the male and female connecting assemblies has been achieved. Thus, the first hand implement 312 is employed not only to correct improper unions between male and female connecting assemblies of adjacent panels forming the standing seam roof (as illustrated in FIG. 14), but the first hand implement 312 is also employed to insure quality control and joint integrity of the standing seam formed between the male and female connecting assemblies of adjacently disposed panels throughout the length of the standing seam.

The first hand implement 312 comprises an elongated body portion 318 and an extension engaging member 320 supported by the body portion 318 at one end thereof. The extension engaging member 320, illustrated as having an arcuate configuration, is provided with an extension engaging surface 322 and opposed male engaging surface 324, and an end portion 326. Thus, upon positioning the extension engaging member 320 in the recessed or cavity portion 316 of the male connecting assembly of the roof panel, such as the male connecting assembly 100 of the roof panel 32, the extension engaging surface 322 partially encompasses the lip engaging member 174 of the male connecting assembly 100 and the lip member 144 of the female connecting assembly 102, the male engaging surface 324 of the extension engaging member 320 is disposed adjacent the third leg member 170 of the male connecting assembly 100, and the end portion 326 is disposed in close proximity to the fourth leg member 172 of the male connecting assembly 100 at a position above the junction of the lip engaging member 174 and the fourth leg member 172. When the extension engaging member 320 of the first hand implement 312 is positioned within the recessed or cavity portion 316 of the male connecting assembly 100 as described above, force can be placed on the elongated body portion 318 of the first hand implement 312 in the direction of the arrow 328. Application of the force on the elongated body portion 318 of the first hand implement 312 in the direction of the arrow 328 causes the first hand implement 312 to pivot about a point 330 so that the end portion 326 of the extension engaging member 320 contacts the fourth leg member 172 of the male connecting assembly 100 and creates a force on the fourth leg member 172 in the direction of the arrow 332. The resulting movement of the fourth leg member 172 of the male connecting assembly 100 in the direction of the arrow 332 (because of the pressure exerted on the fourth leg member 172 by the first hand implement 312 as described above) causes the second end 194 of the lip engaging member 174 of the male connecting assembly 100 to slide along the inclined lip member 144 of the female connecting assembly 102 in the direction indicated by the arrow 184 so that the male connecting assembly 100 is urged upwardly into the male receiving cavity 158 of the female connecting assembly 102 and into proper engagement with the standing seam sealant 108.

In many situations the spring-like nature of the female connecting assembly 102 will cause the second leg 142 of the female connecting assembly 102 to move in the direction indicated by the arrow 240 once the fourth leg member 172 of the male connecting assembly 100 has cleared the second end 156 of the inclined lip member 144 of the female connecting assembly 102 and commenced movement in the direction indicated by the arrow 184. The combined movement of the second end 194 of the lip engaging member 174 along the upper side of the lip member 144 in the direction of the arrow 184, and the movement of the second leg member 142 of the female connecting assembly 102 in the direction represented by the arrow 240 because of its resilient characteristics, will cause the male connecting assembly 100 to move into a proper seating engagement with the tape 230, the curved end portions 126 of the clip member 122 and the standing seam sealant 108 disposed in the apex or upper portion of the male receiving cavity of the female connecting assembly 102 as heretofore described and substantially as shown in FIGS. 10 and 11.

In certain instances the movement of the male connecting assembly of the roof panel forming the standing seam roof assembly by use of the first hand implement 312 as described above may not be sufficient to form a proper union between the male and female connecting assemblies of the adjacently disposed panels forming the standing seam roof assembly. This situation may occur in those instances where an excess of standing seam sealant 108 has been disposed in the upper or apex portion of the male assembly receiving cavity of the female connecting assembly, when the female connecting assembly of the roof panel has been sprung or otherwise damaged or when the friction between the inclined lip member 144 of the female connecting assembly 102 and the lip engaging member 174 of the male connecting assembly 100 is such that the spring action of the male and female connecting assemblies 100, 102 will not overcome it. In such instances the second hand implement 314 is used in combination with the first hand implement 312 to create a counter force on the male and female connecting assemblies and thus insure a proper union between the male and female connecting assemblies of adjacent panels forming the standing seam.

Referring now to FIGS. 14 and 16, the second hand implement 314 comprises a substantially U-shaped housing 340 having an opening 342 formed therein and a handle 344 The housing 340 is formed of a first side plate 346, a specially disposed second side plate 348 and an upper plate 350 interconnecting the first and second side plates 346 and 348 such that the opening 342 is formed therebetween. The width, heighth and length of the opening 342 formed within the housing 340 can vary widely. However, it is desirable that the width of the opening 342 substantially correspond to the width of the female connecting assembly of the panel forming the standing seam roof assembly, such as the female connecting assembly 102 of the panel 34, when the female connecting assembly is in an improper mating relationship with the male connecting assembly, such as the male connecting assembly 100, substantially as shown in FIG. 14. The heighth of the opening 342 is desirably sufficient to enable the housing 340 to be positioned over the upper portion of partially connected male and female connecting assemblies of the panels forming the standing seam, while permitting insertion of the first hand implement 312 into the recessed or cavity portion 316 of the male connecting assembly 100 as heretofore described. The length of the opening 342 will be dependent solely upon the overall length of the housing 340 of the second hand implement 314. Thus, the dimensions of the opening 342 are not critical, provided the opening 342 is designed to compensate and receive the male and female connecting assemblies of the panels forming the standing seam roof as heretofore described. The handle 344 is secured at one end to the upper plate of the housing 340 so as to extend therefrom substantially as shown. The length of the handle 344 can vary widely, the only requirement that the handle 344 be of sufficient length so that a workman can grasp the handle 344 and rotate the second hand implement 314 in the direction of the arrow 352 when the housing 340 of the second hand implement 314 is disposed over the male and female connecting assemblies of adjacently disposed panels forming the standing seam.

In FIG. 14 the second hand implement 314 is illustrated as being disposed over the male and female connecting assemblies 100, 102 of the panels 32, 34 forming the standing seam such that the first hand implement 312 is positioned within the recessed or cavity portion 316 of the male connecting assembly 100. In order to provide a proper union between the male and female connecting assemblies 100, 102 of the panels 32 and 34, respectively, a force is applied to the handle 344 of the second hand implement 314 in the direction represented by the arrow 352 while a force is directed on the elongated body portion 318 of the first hand implement 312 in the direction indicated by the arrow 328. The combination of forces in the direction of the arrows 328 and 352 causes the end portion 326 of the extension engaging member 320 of the first hand implement 312 to engage the fourth leg member 172 of the male connecting assembly 100 of the panel 32 as the extension engaging member 322 is pivoted about the point 330 and the second end 194 of the lip engaging member 174 of the male connecting assembly 100 is caused to slidaby move up the incline of the lip member 144 of the female connecting assembly 102 in the direction of the arrow 184. At the same time, the force applied to the handle 344 of the second hand implement 314 in the direction of the arrow 352 causes the first side plate 346 of the housing 340 of the second hand implement 314 to engage the second leg member 142 of the female connecting assembly 102 of the panel 34 and apply a force thereto in the direction represented by the arrow 354. During rotation of the second hand implement 314 the second side plate 348 of the housing 340 contacts the first leg member 140 of the female connecting assembly 102 of the panel 34. Thus, the combination of force is exerted upon the male and female connecting assemblies 100, 102 is in opposite directions which results in the movement of the second leg member 142 of the female connecting assembly 102 in the direction represented by the arrow 354, and the movement of the third leg member 170 of the male connecting assembly 100 in the direction of the arrow 332. The before-mentioned movement in opposite direction of the first leg member 146 of the female connecting assembly 102 and the third leg member 170 of the male connecting assembly 100 causes the second end 194 of the lip engaging member 174 of the male connecting assembly 100 to ride up the inclined lip member 144 of the female connecting assembly 102, this action urging the male connecting assembly 100 upwardly into the male receiving cavity 158 of the female connecting assembly 102 and into a proper union with the female connecting assembly 102.

Figure 17:
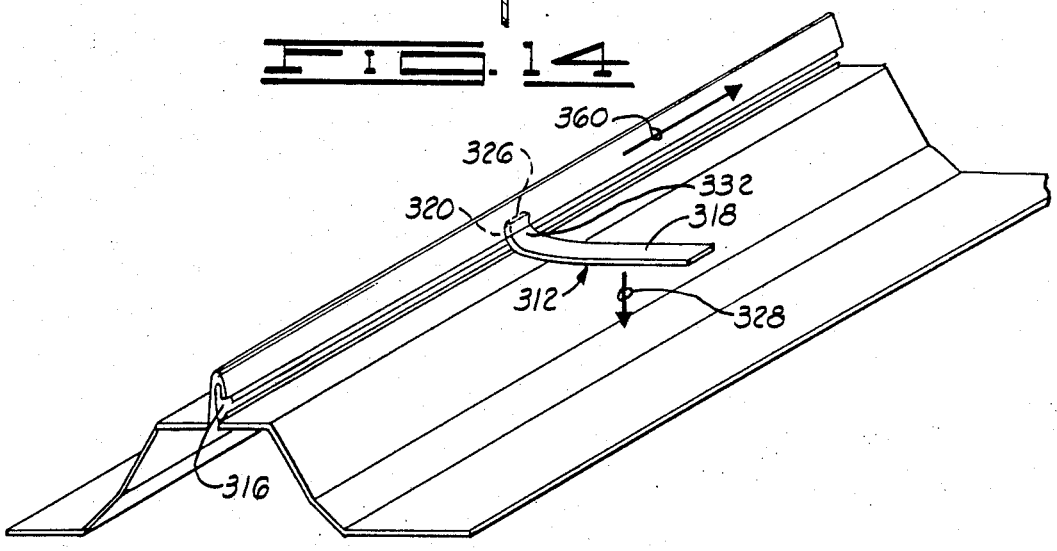
FIG. 17 an isometric view of a portion of the standing seam roof assembly showing the first hand implement positioned within the standing seam to insure joint integrity of the standing seam formed by union of the male and female connecting assemblies of adjacently disposed panels.
Figure 15:
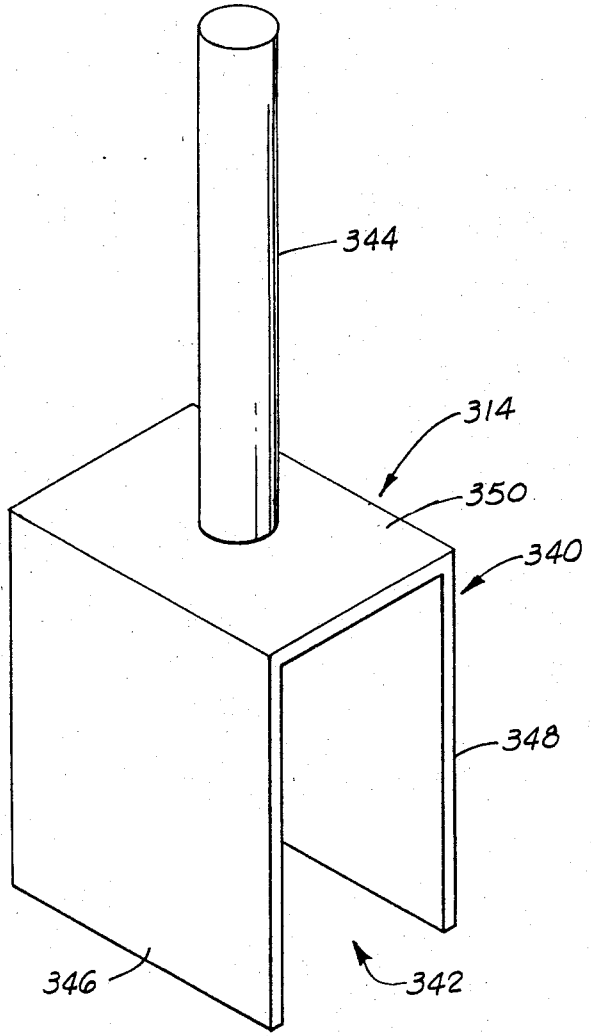
FIG. 15 is an isometric view of a first hand implement employed to insure joint integrity between the male and female connecting assemblies of the adjacently disposed panels forming the standing seam.
Figure 15:
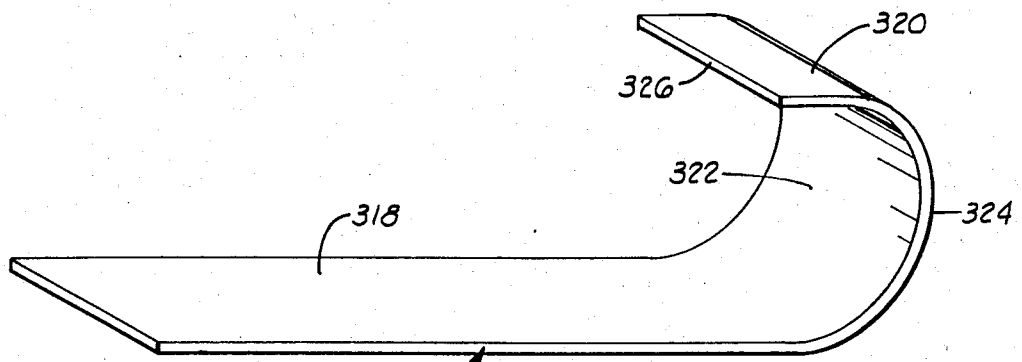

As previously stated, during the formation of the standing seam, even when the male and female connecting assemblies of the standing seam appear to have made a proper union, problems may nevertheless be encountered due to the wave-like characteristics which may be present in the standing seam throughout its length. To insure the joint integrity of the standing seam, and thus the watertightness of the seal formed between the male and female connecting assemblies of adjacently disposed panels forming the standing seam, the extension engaging member 320 of the first hand implement 312 can be disposed within the recessed portion or cavity formed in the male connecting assembly of the roof panel forming the standing seam, such as the recessed portion or cavity 316 of the male connecting assembly 100 of the panel 32 as shown in FIG. 17. In such instance, the first hand implement 312 is desirably moved along the length of the standing seam, such as in the direction represented by the arrow 360. As this movement takes place, the end portion 326 of the first hand implement 312 will intersect portions of the male connecting assembly 100 which are out of position and not properly joined with the female connecting assembly 102 because of the wave-like configuration of the male and/or female connecting assemblies 100, 102 or defects in the fabrication of the male and female connecting assemblies 100, 102. When an improper union between the male and female connecting assemblies 100, 102 is encountered by the end portion 326 of the first hand implement 312 a downward force, in the direction of the arrow 328 on the elongated body portion 318 of the first hand implement 312 can be exerted and the male and female connecting assemblies 100, 102 brought into proper union. The downward force exerted on the elongated body portion 318 of the first hand implement 312 can be continuous (as the extension engaging member 320 is slidably moved through the recessed portion or cavity 316 of the male connecting assembly 100 of the standing seam for substantially the full length thereof), or an intermittant force can be exerted on the elongated body portion 318 of the first hand implement 312.

The amount of force applied to the elongated body portion 318 of the first hand implement 312 can vary widely. However, care should be exercised to insure that the force is only sufficient to insure the proper union of the male and female connecting assemblies of the adjacently joined roof panels forming the standing seam. In other words, excess force should be avoided in order to prevent damage to the standing seam. Thus, the movement of the first hand implement 312 through the recessed or cavity portion 316 of the male connecting assembly 100 of the panel member 32 forming the standing seam will sufficiently correct imperfections formed in the standing seam which may result from the wave-like characteristics and imperfections and substantially enhance the integrity of the joint as formed.

It is clear that the present invention is well adapted to carry out the objects and to attain the ends and advantages mentioned therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A method for enhancing joint integrity of a seam formed by union of adjacently disposed panels wherein one of the panels is provided with a female member having an upstanding first leg member, a spatially disposed downwardly extending second leg member and a lip member, the first leg member, the second leg member and the lip member cooperating to form a male receiving cavity, and wherein the other panel is provided with a male member having an upstanding third leg member, a spatially disposed downwardly extending fourth leg member and a lip engaging member, the method comprising:

inserting the male member into the male receiving cavity of the female member such that the lip engaging member of the male member can be forced into engagement and is supported by the lip member of the female member; and applying a force to the downwardly extending fourth leg member of the male member such that the lip engaging member of the male member slidably moves along the lip member of the female member in a direction away from the upstanding first member of the female member and the third leg member of the male member and urges the male member into a proper union with the female member.

2. The method for enhancing joint integrity of a seam formed by union of adjacently disposed panels of claim 1 wherein the third leg member, the fourth leg member, and the lip engaging member of the male member cooperate to form a cavity, and wherein the method further comprises:

positioning a first hand implement within the cavity of the male member such that a first portion of the first hand implement engages the third leg member of the male member; and applying a force to the first hand implement such that the first hand implement is caused to pivot at the position of engagement of the first portion of the first hand implement with the third leg member and a second portion of the first hand implement contacts the fourth leg member of the male member, the continued application of force on the first hand implement creating force on the fourth leg member of the male member to slidably move the lip engaging member of the male member along the lip member of the female member until a proper union of the male and female members is achieved.

3. The method of enhancing joint integrity of a seam formed by union of adjacently disposed panels of claim 2 further comprising:

positioning a second hand implement over at least a portion of the female member such that the second hand implement engages a portion of the first and second leg members of the female member; and applying a force on the second hand implement in the direction of the force applied to the first hand implement such that resultant forces are created on the second leg member of the female member and the fourth leg member of the male member which are substantially opposite in direction.

4. A method for determining the joint integrity of a seam formed by the union of adjacently disposed panels wherein one of the panels is provided with a female member having an upstanding first leg member, a spatially disposed downwardly extending second leg member and a lip member, the first leg member, the second leg member and the lip member cooperating to form a male receiving cavity, and wherein the other panel is provided with a male member disposed within the male receiving cavity so as to form the joint, the male member having an upstanding third leg member, a spatially disposed downwardly extending fourth leg member and a lip engaging member, the third leg member, the fourth leg member and the lip engaging member defining a cavity in the male member having an opening in a lower portion thereof, the method comprising:

positioning a portion of a first hand implement into the cavity of the male member via the opening; and moving the first hand implement along the seam such that the portion of the first hand implement disposed in the cavity of the male member travels through the cavity substantially unrestricted until encountering an improperly coupled portion of the male and female members whereupon force is applied to the first hand implement to cause the portion of the first hand implement disposed within the cavity to selectively engage the fourth leg member of the male member and move the lip engaging member of the male member along the lip member of the female member such that the male member is directed into the male receiving cavity of the female member.

5. The method for determining the joint integrity of a seam of claim 4 further comprising:

positioning a second hand implement over at least a portion of the female member when encountering an improperly coupled portion of the male and female members, the second hand implement being disposed to contact a portion of the first and second leg members of the female member; and applying a force on the second hand implement such that resultant forces are created on the second leg member of the female member and the fourth leg member of the male member in substantially opposite directions until the proper union of the male and female members is achieved.

6. An improved panel member comprising:

a body portion having a first side and a spatially disposed second side;

a female connecting assembly disposed along at least a substantial portion of the first side of the body portion, the female connecting assembly comprising:

a first leg member having a first end and a second end, the first end of the first leg member connected to the body portion of the panel member along the first side such that the first leg member is substantially normally disposed to the body portion;

a second leg member having a first end and a second end, the first end of the second leg member being connected to the second end of the first leg member, the second leg member extending from the first leg member such that an acute angle is formed between the first and second leg members; and a lip member having a first end and a second end, the first end of the lip member being connected to the second end of the second leg member such that the lip member is substantially normally disposed to the second leg member and extends in the direction of the first leg member, the second leg member and the lip member cooperating to define a male assembly receiving cavity;

a male connecting assembly disposed along at least a substantial portion of the second side of the body portion, the male connecting assembly comprising:

a third leg mesber having a first end and a second end, the first end of the third leg member connected to the body portion of the panel member along the second side such that the third leg member is substantially normally disposed to the body portion and substantially parallel to the first leg member of the female connecting assembly;

a fourth leg member having a first end and a second end, the first end of the fourth leg member being connected to the second end of the third leg member, the fourth leg member extending from the third leg member such that an acute angle is formed between the third and fourth leg members; and lip engaging means formed on the second end of the fourth leg member for engaging the lip member of the female connecting assembly of an adjacently disposed panel member when the male connecting assembly of one panel member is positioned within the male assembly receiving cavity formed in the female connecting assembly of an adjacent panel member so as to form a standing seam joint by union of the female and male connecting assemblies of the adjacently disposed panel members, thelip engaging means adapted to be moved along the lip member of the female connecting assembly in a first direction towards the second leg member of the female connecting member during insertion and final assembly of the adjacently disposed panel members so that movement of the lip engaging means is resisted in a second direction away from the second leg member of the female connecting assembly when the connected panel members expand, contract and are subjected to load and stress, the lip engaging means comprising an arcuate shaped member having a first end and a second end, the first end of the arcuate shaped member being connected to the second end of the fourth leg menber of the male connecting assembly, the second end of the arcuate shaped member adapted to bite into the lip member of the female connecting assembly when the female and male connecting assemblies are in an assembled position and load and stress placed on the connected panel member tends to move the arcuate shaped member of the male connecting assembly in the second direction along the lip member of the female connecting assembly; and a resilient sealant disposed within an upper portion of the male assembly receiving cavity defined by the junction of the first and second leg members of the female connecting assembly such that upon positioning the male connecting assembly in the male assembly receiving cavity of the female connecting assembly and forcing the male connecting assembly upwardly into the male assembly receiving cavity of the female connecting assembly, the female and male connecting assemblies cooperate to compress the resilient sealant and form a substantially uniform, watertight seal therebetween.

7. An improved panel member comprising:

a body portion having a first side and a spatially disposed second side;

a female connecting assembly disposed along at least a substantial portion of the first side of the body portion, the female connecting assembly comprising:

a first leg member having a first end and a second end, the first end of the first leg member connected to the body portion of the panel member along the first side such that the first leg member is substantially normally disposed to the body portion;

a second leg member having a first end and a second end, the first end of the second leg member being connected to the second end of the first leg member, the second leg member extending from the first leg member such that an acute angle is formed beteeen the first and second leg members; and a lip member having a first end and a second end, the first end of the lip member being connected to the second end of the second leg member such that the lip member is substantially normally disposed to the second leg member and extends in the direction of the first leg member, the second leg member and the lip member cooperating to define a male assembly receiving cavity;

a male connecting assembly disposed along at least a substantial portion of the second side of the body portion, the male connecting assembly comprising:

a third leg member having a first end and a second end, the first end of the third leg member connected to the body portion of the panel member along the second side such that the third leg member is substantially normally disposed to the body portion and substantially parallel to the first leg member of the female connecting assembly;

a fourth leg member having a first end and a second end, the first end of the fourth leg member being connected to the second end of the third leg member, the fourth leg member extending from the third leg member such that an acute angle is formed between the third and fourth leg members; and lip engaging means formed on the second end of the fourth leg member for engaging the lip member of the female connecting assembly of an adjacently disposed panel member when the male connecting assembly of one panel member is positioned within the male assembly receiving cavity formed in the female connecting assembly of an adjacent panel member so as to form a standing seam joint by union of the female and male connecting assemblies of the adjacently disposed panel menbers, the lip engaging means adapted to be moved along the lip member of the female connecting assembly in a first direction towards the second leg member of the female connecting member during insertion and final assembly of the adjacently disposed panel members so that movement of the lip engaging means is resisted in a second direction away from the second leg member of the female connecting assembly when the connected panel members expand, contract and are subjected to load and stress, the lip engaging means comsprising an arcuate shaped member having a first end and a second end, the first end of the arcuate shaped member being connected to the second end of the fourth leg member of the male connecting assembly, the second end being disposable substantially adjacent the lip member of the female connecting assembly when the male connecting assembly is disposed within the male assembly receiving cavity of the male connecting assembly;

stop means formed on the lip member of the female connecting assembly for engaging the lip engaging means of the male connecting assembly when the female and male connecting assemblies are in a proper mating relationship and forming the standing seam joint, the stop means allowing for movement of the lip engaging means along the lip member in the first direction and resisting movement of the lip engaging means along the lip member in the second direction, the stop means formed on the lip member of the female connecting assembly and the arcuate shaped member of the lip engaging means of the male connecting assembly cooperation such that as the arcuate shaped member is moved along the lip member in the first direction the arcuate shaped member passes over the stop means to allow the female and male connecting assemblies to be disposed in the proper mating relationship, the second end of the arcuate shaped member engaging the stop means when the female and male connecting assemblies are in the proper mating relationship to prevent movement of the arcuated shaped member in the second direction when the assembled panel members expand, contract and are subjected to load and stress; and a resilient sealant disposed within an upper portion of the male assembly receiving cavity defined by the junction of the first and second leg members of the female connecting assembly such that upon positioning the male connecting assembly in the male assembly receiving cavity of the female connecting assembly and forcing the male connecting assembly upwardly into the male assembly receiving cavity of the female connecting assembly, the female and male connecting assemblies cooperating to compress the resilient sealant and form a substantially uniform, watertight seal therebetween.

8. The improved panel member of claim 7 wherein the stop means comprises at least one projecting member formed on the lip member of the female connecting assembly.

9. An improved standing seam floating roof assembly comprising:

at least two adjacently disposed panel members, each of the panel members having an elongated first side and a spatially disposed second side;

a female assembly of a standing seam joint formed along at least a substantial portion of one of the first and second sides of each of the panel members, the female assembly defining a male receiving cavity, the female assembly further characterized as including a lip member extending across a portion of the male receiving cavity to partially close off an opening to the male receiving cavity, the lip member having a first end and a second end, the female assembly further comprising:

a first leg member having a first end and a second end, the first end being connected to the panel members along one of the first and second sides such that the first leg member is substantially normally disposed to the plane of the panel member; and a second leg member having a first end and a second end, the first end of the second leg member being connected to the second end of the first leg member so as to form a first apex therebetween, the first apex defining the upper portion of the male receiving cavity, the first end of the lip member being connected to the second end of the second leg member such that the lip member is provided with an incline from its second end to its first end, and partially restricting a lower portion of the male receiving cavity; and a male assembly of a standing seam joint formed along at least a substantial portion of the other one of the first and second sides of each of the panel members, the male assembly being characterized as including a lip engaging member disposed such that upon positioning the male assembly into male receiving cavity of the female assembly, the lip engaging member of the male assembly engages the lip member of the female assembly and is moveable in a first direction to direct the male assembly into mating relationship with the female assembly, the lip engaging member and the lip member being constructed such that during and after assembly of the male and female assemblies movement of the lip engaging member along the lip member of the female assembly is resisted in a second direction substantially opposite the first direction so that the roof assembly is retained in its assembled position when the connected panel members expand, contract and are subjected to load stress, the lip engaging member of the male assembly being an arcuate shaped member having a first end and a second end, and the male assemsbly further comprising:

a third leg member having a first end and a second end, the first end being connected to the panel members along the other of the first and second sides such that the third leg member of the male assembly is substantially parallel to the first leg member of the female assembly; and a fourth leg menber having a first end and a second end, the first end of the fourth leg member leg member being connected to the second end of the third leg member so as to form a second apex therebetween, the second apex defining an upper portion of the male assembly, the first end of the lip engaging member being connected to the second end of the fourth leg member such that the lip engaging member extends therefrom in the direction of the third leg member and the second end of the lip engaging member engages the lip member of the female assembly when the male assembly is properly seated within the male receiving cavity of the female assembly to prevent movement of the lip engaging member in the second direction.

10. The improved standing seam floating roof assembly of claim 9 further comprising:

a resilient sealant disposed in the first apex of the female assembly such that upon positioning the male assembly into the male receiving cavity of the female assembly the second apex of the male assembly moves into a mating relationship with the first apex of the female assembly and substantially uniformily compresses the resilient sealant to form a watertight seal.

11. The improved standing seam floating roof assembly of claim 10 wherein the roof assembly is supported by an infrastructure and wherein the roof assembly further comprises:

clip means mounted on the infrastructure and disposed between the first leg member of the female assembly and the third leg member of the male assembly for securing the panel member to the infrastructure.

12. The improved standing seam floating roof assembly of claim 11 wherein the clip means comprises:

a base portion;

a web portion slidably mounted in the base portion; and at least one upright member having a first end and a second end, the first end connected to the web portion such that the upright member extends from the web portion, the second end portion of the upright member having a curved configuration such that in an assembled position of the female assembly, the male assembly and the clip means, the upright member of the clip means is disposed between the first leg member of the female assembly and the third leg member of the male assembly and the second end portion of the upright member is disposed over the second apex of the male assembly and in contact with the resilient sealant contained within the first apex of the female assembly.

13. The improved standing seam floating roof assembly of claim 12 wherein the clip means further comprises:

a resilient sealant disposed in the second end portion of the upright member so that in an assembled position the second apex of the male assembly contacts the resilient sealant disposed in the second end portion of the upright member.

14. The improved standing seam floating roof assembly of claim 13 wherein the clip means further comprises:

fastener means for securing the base portion to the infrastructure.

15. The improved standing seam floating roof assembly of claim 12 further comprising:

projection means mounted on the web position of the clip means for engaging a portion of the panel member and preventing relative motion between the web portion and the panel member.

* * * * *

UNITED STATES PATENT AND TRADEMARK OFFICE

CERTIFICATE OF CORRECTION

PATENT NO. : 4,700,522

DATED : October 20, 1987

INVENTOR(S) : Harold G. Simpson

It is certified that error appears in the above-identified patent and that said Letters Patent is hereby corrected as shown below:

On the cover sheet, under Section [75] Inventor, the name "Harold S. Simpson" should read --Harold G. Simpson--;

In column 2, line 31, the words ". standing seam" should read --. The standing seam--. In column 4, line 46, the words "in with the" --in accordance with the--. In column 5, line 9, the words "of the standing seam of the standing seam" should read --of the standing seam--. In column 6, line 35, the words "a opposed second" should read --an opposed side--. In column 7, line 42, the word "throught" should read --through--. In column 13, line 4, the word "asembly" should read --assembly--. In column 20, line 7, the word "spearate" should read --separate--; in column 20, line 36, the word "assemlby" should read --assembly--. In column 23, line 23, the word "slidaby" should read --slidably--. In column 26, line 54, the word "mesber" should read --member--. In column 27, line 11, the words "thelip" should read --the lip--. In column 28, line 48, the word "comsprising" should read --comprising--. In column 29, line 3, the word "cooperation" should read --cooperating--. In column 30, line 18, the word "assemsbly" should read "assembly".

Signed and Sealed this

Fourth Day of October, 1988

*Attest:*

DONALD J. QUIGG

*Attesting Officer*

*Commissioner of Patents and Trademarks*